US008844758B1

(12) United States Patent
Kummer

(10) Patent No.: US 8,844,758 B1
(45) Date of Patent: Sep. 30, 2014

(54) INTERLOCKING ASSEMBLY OF CONTAINERS, CLOSURES, HOLDING APPARATUS AND METHODOLOGY

(76) Inventor: William J. Kummer, Cincinnati, OH (US)

( * ) Notice: Subject to any disclaimer, the term of this patent is extended or adjusted under 35 U.S.C. 154(b) by 606 days.

(21) Appl. No.: 13/154,894

(22) Filed: Jun. 7, 2011

Related U.S. Application Data

(62) Division of application No. 11/421,907, filed on Jun. 2, 2006, now abandoned.

(60) Provisional application No. 60/687,553, filed on Jun. 3, 2005.

(51) Int. Cl.
*B65D 21/036* (2006.01)

(52) U.S. Cl.
USPC ..... 220/636; 220/630; 220/4.27; 206/508

(58) Field of Classification Search
CPC ..... B65D 21/02; B65D 61/00; B65D 25/24; A01J 25/00
USPC ..... 220/4.27, 4.26, 630, 628, 636; 206/508, 206/503
See application file for complete search history.

(56) References Cited

U.S. PATENT DOCUMENTS

| | | | | |
|---|---|---|---|---|
| 2,326,414 | A | 1/1940 | Thompson | |
| 2,687,231 | A | 8/1954 | Somers | |
| 2,836,323 | A | 5/1958 | Robinson | |
| 2,910,219 | A * | 10/1959 | Bennett et al. | 220/737 |
| 2,997,199 | A * | 8/1961 | Reachi | 220/23.86 |
| 3,327,881 | A | 6/1967 | Maier | |
| 3,369,691 | A | 2/1968 | Wei | |
| 3,465,905 | A | 9/1969 | Schottanes | |
| 3,552,548 | A | 1/1971 | Wallestad | |
| 4,078,686 | A | 3/1978 | Karesh | |
| 4,339,046 | A | 7/1982 | Coen | |
| 4,386,701 | A | 6/1983 | Galer | |
| 4,429,786 | A | 2/1984 | Hucal | |
| 4,444,324 | A | 4/1984 | Grenell | |
| 4,474,303 | A | 10/1984 | Maccise | |
| 4,485,923 | A | 12/1984 | Schwaikert | |
| 4,598,832 | A | 7/1986 | Alonso | |
| 4,600,111 | A | 7/1986 | Brown | |
| 5,154,195 | A | 10/1992 | Stoner | |
| 5,312,011 | A | 5/1994 | Fischer | |

(Continued)

*Primary Examiner* — Stephen Castellano
(74) *Attorney, Agent, or Firm* — Faegre Baker Daniels LLP

(57) ABSTRACT

A comprehensive storage and packaging system solution includes designs for container, closure, and holding apparatus. Container, closure and holding apparatus are interlocked together in mated combinations with interlocking connectors at connection hubs. This storage and packaging system includes design and methodology for secure and convenient collection, sorting, storage, presentation, and flexible transport of reclosable containers and the container's content. A plurality of container portability and secure transport is enhanced with the implementation of interlocking connection hubs. A single closed container joins into an interlocking container assembly at connection hubs. Container assemblies range from a single column, row or tube to an entire three dimensional spatial interlocking matrix. Use of the connection hubs with holding apparatus devices such as tote trays and carousel disks provide capabilities for the integration of containers, container assemblies, and holding apparatus or devices within this storage system solution. Modular design of holding apparatus provides for the controlled, organized, and flexible growth of this storage system solution. Together, functionally integrated containers, closures, and holding apparatus for this storage system solution provide for a well organized, convenient, portable, and user reconfigurable collection and worksite presentation of container contents including nuts, bolts, electrical connectors, tooling, hardware, and other collectables.

18 Claims, 17 Drawing Sheets

(56) References Cited

U.S. PATENT DOCUMENTS

| | | | |
|---|---|---|---|
| 5,339,975 | A | 8/1994 | Stoner |
| 5,383,558 | A | 1/1995 | Wilkinson et al. |
| 5,415,309 | A | 5/1995 | Wang |
| 5,422,129 | A | 6/1995 | Draddy |
| 5,489,036 | A | 2/1996 | Arkins |
| 5,535,908 | A | 7/1996 | Sheu |
| 5,542,206 | A | 8/1996 | Lisch |
| 5,573,133 | A | 11/1996 | Park |
| 5,598,928 | A | 2/1997 | Hossard et al. |
| 5,607,057 | A | 3/1997 | Eches et al. |
| 5,611,448 | A | 3/1997 | Chen |
| 5,649,638 | A | 7/1997 | Roy et al. |
| 5,655,673 | A | 8/1997 | Weterrings et al. |
| 5,669,523 | A | 9/1997 | Mueller et al. |
| 5,671,856 | A | 9/1997 | Lisch |
| 5,699,925 | A | 12/1997 | Petruzzi |
| 5,931,323 | A | 8/1999 | Wilkinson et al. |
| 6,085,908 | A | 7/2000 | Lento |
| 6,357,615 | B1 | 3/2002 | Herr |
| 6,612,451 | B2 | 9/2003 | Tobias et al. |
| D497,718 | S | 11/2004 | Taccolini et al. |
| 6,983,946 | B2 | 1/2006 | Sullivan et al. |
| 7,040,500 | B2 | 5/2006 | Kipperman et al. |

* cited by examiner

Fig. 3
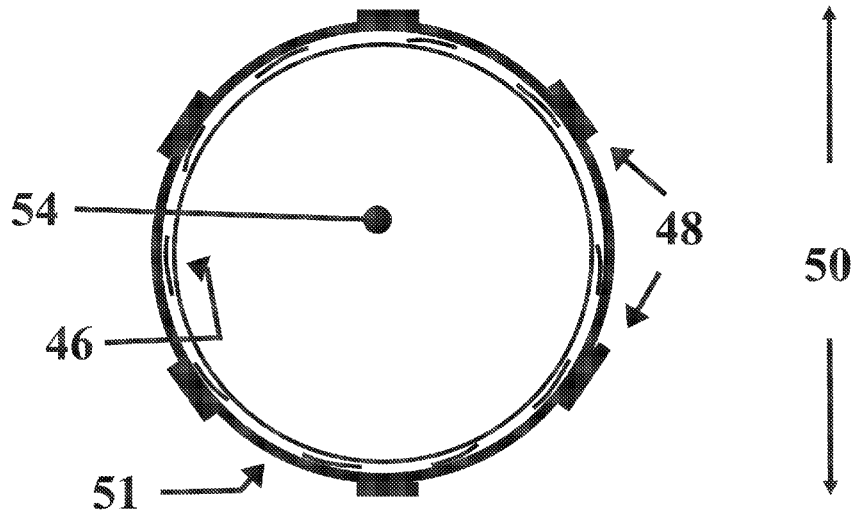
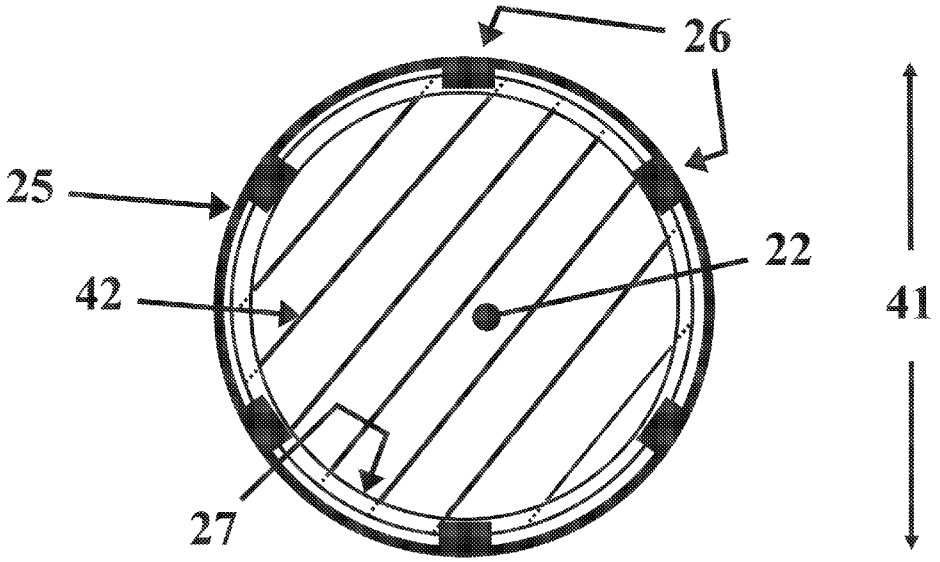
Fig. 2

138
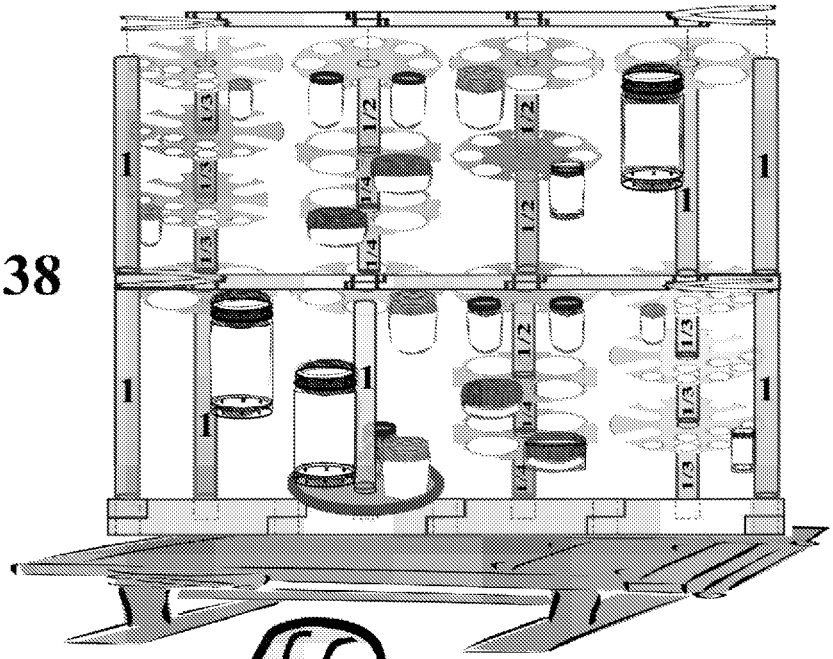
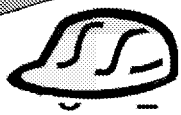
Fig. 19
140
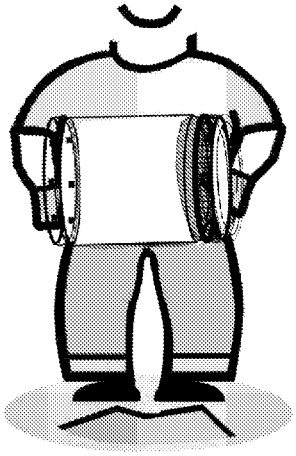

Fig. 23
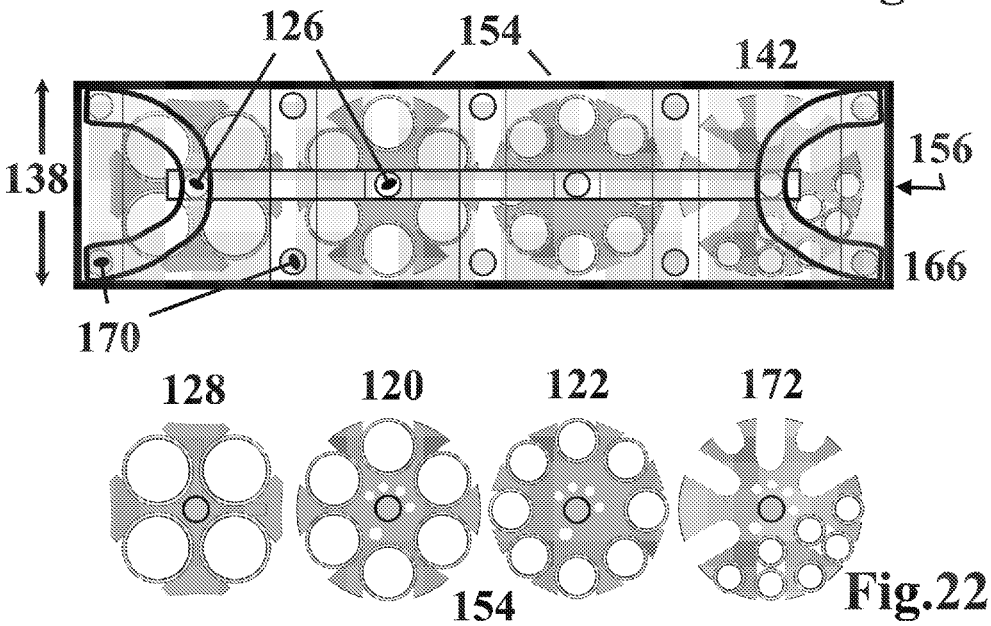
Fig.22
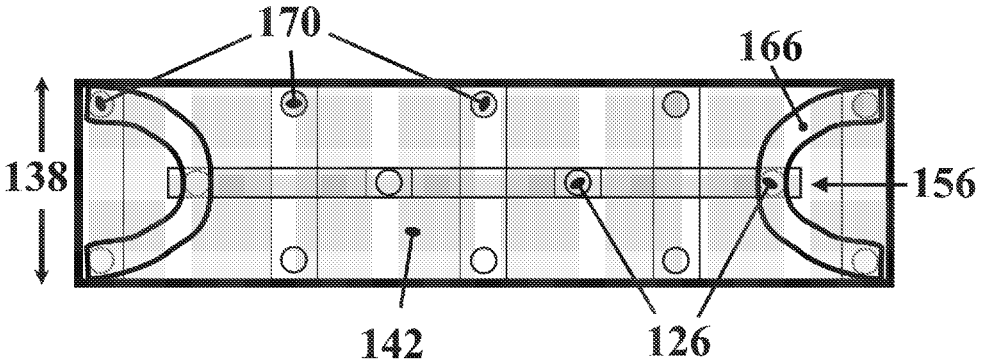
Fig. 21

INTERLOCKING ASSEMBLY OF CONTAINERS, CLOSURES, HOLDING APPARATUS AND METHODOLOGY

CROSS-REFERENCE TO RELATED APPLICATIONS

This application is a divisional of U.S. application Ser. No. 11/421,907, filed Jun. 2, 2006, now abandoned, which claims the benefit of Provisional Patent Application Ser. No. 60/687,553 filed on Jun. 3, 2005, the disclosures of which are expressly incorporated by reference herein.

BACKGROUND

1. Field of Invention

This invention relates to containers, packaging, closures, holding apparatus, integrated organization, interlocking assembly and storage systems.

2. Discussion of Prior Art

Tradesmen and home workshop hobbyists have historically stored their vast collections of bolts, nuts, and other fasteners in glass baby food jars and clear plastic food jars, with screw lid tops (e.g. 1½ quart peanut butter clear plastic jars). Crown Bolt LLC, Aliso Viejo, Calif. markets a "Clear-Can" squeezable sleeve that is a clear cylindrical tube with threading top and bottom.

The hardware parts storage market is dominated by the availability of open bins or trays. Some with moveable bin dividers. Product is often shipped in cardboard boxes and displayed in open bins. There are a few packaging examples of electrical nuts shipped in nondurable clear plastic packaging and bolts packaged in clear vinyl jars with screw top lids.

Plastic or metal drawers and toolboxes with removable trays are also used for storage of parts and tooling.

None of these retail product and packaging is designed for interlocking container assembly and the interlocking connection to holding apparatus or equipment.

PRIOR ART

Individual Prior Art provides incomplete detail compared to my complete storage system solution.

Prior Art of locking containers have limited application. Locking latch fasteners are used within ammunition charge stacking to aid in the connected coupling of two or more charges and projectiles.

Snap fits typically fail under heavy force loads at separation points or with distortion of the container body when dropped from sufficient heights.

Examples of stacking both containers and closures on containers exist in prior art but none have a simple secure, complete system for the repetitive, interlocking stacking or interlocking assembly, of a plurality of containers. Further, none have the application focus and perform repetitive interlocking stacking without duplicating the mechanical motion required to repetitively engage or disengage the closure of these containers.

The duplication of threaded closures with threaded stacking of containers is common. This arrangement results in the unexpected disengagement of a container assembly while trying to only unthread a closure. Similarly, trying to threading disengage a container within an assembly may result in the unexpected disengagement of a closure or lid.

Stacking of containers as described in prior art is usually associated with the flat and level surface stacking of one container's bottom surface on the top surface of another similar shaped container.

Much Prior art is dedicated to the nested stacking of containers, by placing an annular rim of a top container's bottom into the slightly larger annular rim of a lower containers top surface, or vice versa. When nested containers are lifted by higher stacked containers, the stack separates. This is often by design for the limited application of static inventory.

However, this is not advantages for the desired result of lifting an assembly by any container and the entire assembly remaining intact or interlocked. The problem of unintentional disassembly of stacked or nested containers is further aggravated if the stack is manipulated, jostled, tilted to severe angles, quickly rotated, or even turned upside down. The stacked assembly fails.

Also, prior art exists with a dedicated two or tandem container arrangement with closure threads sealing the tandem containers top and bottom openings, or adding a bottom footing to a closed bottom container. Food containers often have a tandem arrangement such as with thermos and food trays. Redundant acting threaded fastening leads to ambiguity of action on closures versus container stacking connections.

Still many interlocked container assemblies rely on the exposed bottom portion of an upper container to perform both the role of closure and interlocking by performing as a lid or cap to the adjacent lower container. This results in potential contamination of the lower units contents by the upper unit's bottom side. Further, what if you need a plurality of separately closed containers? You are limited to the availability of only a single closure or lid for a plurality of open containers.

Prior art exists on the fastening of container stacks which are not designed for diverse storage use nor for convenient transport. Not everyone has or needs a forklift to transport their storage system. What if you need to reclose your container or reassemble you container stacking order thousands of time? You need a system designed with durability for intended combination activity of repetitive closure and repetitive interlocking container assemblies.

Also, prior art places restrictions on assembly order where some containers do not have the flexibility of design to be assembled in any order or position within the interlocking container assembly. Finally, you need an interlocking container assembly connection that will not fail due to inadequate friction fit or grasp.

PRIOR ART REFERENCES

1. U.S. Pat. No. 4,598,832 to Alonso reveals a system of coupling cylindrical, sectioned containers, threaded to threaded container tube, by using a special coupling ring.
2. U.S. Pat. No. 5,415,309 to Wang shows food containers with a specialized utensil attachment and dual rotation fastening
3. U.S. Pat. Nos. 5,154,295 and 5,339,975 to Stoner reveal double end threaded beer cans for promotional displays.
4. U.S. Pat. No. 5,422,129 to Draddy shows a double threaded compartment.
5. U.S. Pat. No. 5,573,133 to Park reveals threaded beer can stacking
6. U.S. Pat. No. 5,598,928 to Hossard and U.S. Pat. No. 5,607,057 to Eches and U.S. Pat. No. 5,649,638 to Roy show lockable stacking of ammunition charge-packs and rounds.
7. U.S. Pat. No. 5,611,448 to Chen reveals a wafer container for stacking integrated-circuit wafers.
8. U.S. Pat. No. 5,671,856 to Lisch shows locking trays with a single lid on top of stack.
9. U.S. Pat. No. 5,699,925 to Petruzzi shows tongue and grove snap stacking of containers.

10. U.S. Pat. No. 7,040,500 to Kipperman reveals a container with scoop and projections for nested stacking.
11. U.S. Pat. No. 5,312,011 to Fischer reveals a double snap fit of container lid and stacking.
12. U.S. Pat. No. 4,386,701 to Galer reveals nested stacking with mated rims for tilting up to 45 degrees off vertical before stack failure.
13. U.S. Pat. No. 4,474,303 to Maccise shows food container stacking by tongue and groove and has rods going thru holes to stack.
14. U.S. Pat. No. 4,485,923 to Schwaikert reveals a form of Child-Resistant-Closure (CRC) for container closure, but container stacking is detailed by nesting with plugs and recesses.
15. U.S. Pat. No. 5,383,558 to Wilkinson and U.S. Pat. No. 5,489,036 to Arkins and U.S. Pat. No. 5,931,323 to Wilkinson reveals a triple seal container with double nesting a concave bottom over convex lid top, plus lugs resting in recess, to prevent spinning within the nested fit.
16. U.S. Pat. No. 5,669,523 to Mueller shows nesting stacked containers.
17. U.S. Pat. No. 2,687,231 to Somers, and U.S. Pat. No. 2,836,323 to Robinson, and U.S. Pat. No. 3,327,881 to Maier show stacking devices or tandem container assemblies such as a thermos.
18. U.S. Pat. No. 3,465,905 to Schottanes reveals dual or multiple vacuum bottle containers.
19. U.S. Pat. No. 4,078,686, issued to Karesh discloses a two way jar for containing two different liquids. U.S. Pat. No. 4,339,046 to Coen reveals a nursing bottle threaded cap at the bottom of a container for easy access to a liquid retaining bag piston. These devices have threaded caps at both ends,
20. U.S. Pat. No. 4,429,786 to Hucal discloses the technique of stacking container assemblies in tandem; this merely presents the concept of compartmentalization of several Contact Lens Solution modules for eye care.
21. U.S. Pat. No. 4,444,324 to Grenell describes an insulated two-part food container joined by mean of an internal cylinder threaded on its outer surface.
22. U.S. Pat. No. 4,600,111 to Brown shows a Toddler Cup with a double threaded compartment for dual storage
23. U.S. Pat. No. 5,535,908 to Sheu shows multiple threaded containers with a single lid on top of the stack.
24. U.S. Pat. No. 5,542,206 to Lisch shows a Fish and Tackle stack of trays, with a single lid on top.
25. U.S. Pat. No. 5,655,673 to Weterrings reveals a spice rack for holding jars.
26. U.S. Pat. No. 6,357,615 to Herr reveals a Child Resistant Closure (CRC) for a container, without special means for stacking
27. U.S. Pat. No. 6,612,451 to Tobias reveals a wide-mouth, blow molded plastic jar with a special base for nested stacking
28. U.S. Design Pat. No. D497,718 to Taccolini reveals a clear plastic storage container with friction fitting caps for the top and bottom of a cylindrical tube.
29. U.S. Pat. No. 6,983,946 to Sullivan reveals transportable containers apparatus and method.

What is missing in prior art is an integrated system design and functional capability to frequently and conveniently repeat both the secure closure and the secure interlocking assembly of containers. This problem is especially manifested when the interlocked container assembly is a high plurality of individual container units. Prior art has difficulty with unintentionally disengaging containers' closure and unintentionally disengaging an interlocking container assembly.

Also missing among containers and container assemblies is the apparatus holding capability, to handle and manipulate these units. Thus, options for storing, presenting, and maneuvering prior art containers and their content at worksites are limited. This problem is especially manifested if you have a large number of containers and hardware packaging to organize and display content both in the workshop and at the jobsite.

Prior art is missing secure, quick engagement and quick disengagement of interlocking connections, that are durable and capable of frequent reconnection. Stacking and nesting options frequently fail when dependent on gravity and a friction fit or fastening. Prior art is missing an interlocked container assembly solution that is secure and capable of being turned to a plurality of angles, upside down, and even shaken. Some container assemblies have the same threading mechanical motion for container closure that is also used for threading one container to another container.

Prior art has bulky and cumbersome partial system options. A simple and effective solution is needed that is cost effective. Prior art is missing a compact, durable closure that is capable of repetitive container closures and interlocking anywhere within a container interlocking assembly.

Prior art is missing this same solution that effectively interacts and interlocks with holding apparatus or fixturing that utilizes the same container and closure unit. Missing is the storage system to effectively take this workshop solution on the road, into the field, to remote worksite locations.

Finally, missing is the storage and packaging container solution that has all the afore mentioned features yet retains the simple elegance to perform as a standalone reclosable storage unit, with the expected features of traditional free-form balanced stacking and attractive packaging for display of retail product and its container contents.

SUMMARY

My storage system solution is a container storage and packaging system with holding apparatus and methodology. Flexibility in design provides many options for the user to collect, sort, and arrange containers and their contents. Containers securely connect into interlocked container assemblies. Ease of reconfiguration of container assemblies is quick and not confused with container closure. Interlocking at connection hubs, container holding apparatus devices provide an essential aid for the collection, organization, portability, and work presentation of one or a plurality of containers and their contents.

OBJECTS AND ADVANTAGES

Accordingly, there are several objects and advantages to my storage system solution, including a complete solution to the interlocking container assembly of re-closeable storage containers. Individual containers retain their full stand-alone functionality when not joined within a stored and transportable interlocking container assembly. To connect a re-closeable storage container to an interlocking container assembly does not require additional parts.

The interlocking container assembly connectors are an unobtrusive element of each closure and each container. Interlocking connectors do not interfere and do not mechanically compete with traditional threaded closure fastening. Disengaging an interlocking container assembly connection with a simple compression force or push on the joint and twist rotation of joint will not disengage the threading closure fastening.

The Preferred Embodiment is a visually clear or transparent plastic wide-mouth storage container or jar. Jar sizes vary from small height to full height. Jar diameters or rectangular girth range from small to large. Threading closures with color coded rims and clear centers provide high visibility and quick identification means of jar contents. More Specifically, jar heights are preferably sized so that the interlocking container assembly of four one-forth height jars, and three one-third height jars, and two one-half height jars equate in height to a full height jar.

In addition to container closure capabilities, each unit provides means for a secure interlocking container assembly to adjacent compatible units. Thus, individual units are fully functional alone or as a member of an interlocking container assembly or interlocked by a connection hub with a holding apparatus device.

As the preferred embodiment, interlocking container assembly connectors are Child-Resistant-Closure (CRC) connections. Each closure's exterior wall annularly presents a male or female CRC plurality of evenly spaced connectors. Accordingly, the opposite CRC fastening mate is annularly presented along the wall within the exterior jar bottom's concaved recess. Mating motion is a simple compression and twist. CRC fasteners are durably designed for repetitive connections. A plurality of container units within a container assembly is possible. Simple tubes, stacks, or columns of interlocking container assemblies may be transported as is or grouped with the aid of a simple looped fabric straps and a connected shoulder harness.

Together, this storage system solution's container provides a compact container body and a low profile closure unit design.

A CRC coupling or interlocking connection is characteristic of a secure fastening that requires a directed linear effort in addition to a twisting or rotational effort to disengage the coupling. This dual, intentional motion with effort, prevents unintentional disengagements of joints. This simultaneous effort required for interlocking disconnections is distinctly different from the pure full rotational motion required for threading closure disengagement.

This complete storage and transport system is a complete solution. However, by means of the integrated CRC connectors, this same reclosable container and repetitively interlocked enabled unit provides the means to utilize productive apparatus holding fixtures or equipment that are compatible with the interlocking container assembly CRC connector.

Other objects and advantages include that apparatus container collection holding devices provide the capability to custom assemble containers into organized collections per work task at hand. Apparatus holding devices with CRC stud enabled connectors include tote or carrier trays, rotating carousel disk carriers, portable expanding tote tree stands, and a modular in growth designed carousel stand that is limited in size only to your workbench or floor space allowance.

These holding apparatus complete a well-designed and integrated system. This solution's capabilities for collection, storage, sorting, high visibility, highly portable transport, work task ergonomic or angle presentation, and ease of container content access, custom matches the user's preferred workplace habits and desires. With the user's changing work preferences, he or she is able to quickly and easily reconfigure their storage system with the system's storage components already nearby.

Vast collections of bolt, nuts, electrical connectors, and hardware of varying size will store within the preferred embodiment of clear plastic wide-mouth jar containers. The professional contractor and home improvement advocates are not the only users of variable-content storage systems. Industrial technicians practicing "just-in-time-inventory" are searching for an affordable, effective, and efficient solution to replenish morning and afternoon parts assembly stations. This portable storage system is a solution for secure container storage and frequent transport from a locked inventory room to a remote worksite.

What is missing in prior art is an integrated system design and functional capability to frequently and conveniently repeat both the secure closure and the secure interlocking assembly of containers. This problem is especially manifested when the interlocked container assembly is a high plurality of individual container units. This storage system solution avoids unintentionally disengaging containers' closure and unintentionally disengaging an interlocking container assembly.

Also missing among containers and container assemblies is the apparatus holding capability, to handle and manipulate these units. Thus, options for storing and maneuvering prior art containers at worksites are limited. However, with this storage system solution and the creative use of the interlocking container connectors or connection hubs, container manipulation options are increased. You can arrange holding apparatus to position one or a plurality of containers at the angle and worksite location you desire.

Prior art is missing secure, quick engagement and quick disengagement of interlocking connections, that are durable and capable of frequent reconnection. Stacking and nesting options frequently fail when dependent on gravity and a friction fit or fastening. This interlocked container assembly solution is secure and capable of being turned to a plurality of angles, upside down, and even shaken.

Prior art has bulky and cumbersome partial system options. This solution is elegant, cost effective and compact in design. The closure lid performs both container closure and interlocking container assembly. Individual closure and container units maintain all of the traditional handling and packaging capabilities that users demand from storage and packaging. Additionally, holding apparatus provides interlocked connection hubs to container assemblies, for ease of transport and worksite access to container content.

Further Objects and Advantages of my storage system solution will become apparent from a consideration of the drawings and ensuing description.

DESCRIPTION OF DRAWING FIGURES

FIG. 2 is a bottom-side view of a jar bottom's exterior recess with interlocking connections.

FIG. 3 is a bottom-side view of a jar closure with external wall interlocking connectors and internal wall closing threads.

FIGS. 6*a*-6*f* are representative photos of CRC interlocking container assembly connectors. For prototype modeling the CRC fastener representations are magic-markered onto the closure and jar bottom connection mates for the connection hub. In this prototype the interlocking hub is with mated threads.

Figure 6A:
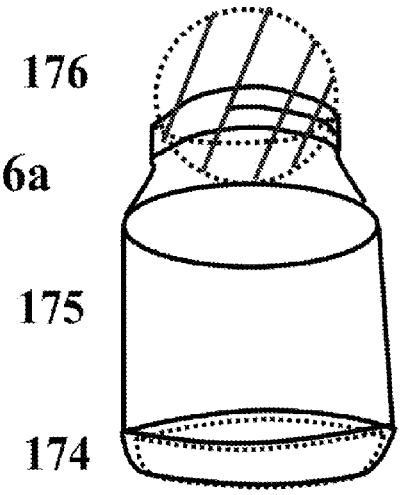

FIG. 6*a* is a side view photo of a wide-mouth plastic jar with a welded bottom. The jar's wide-mouth is resting on a threaded closure.

Figure 6B:
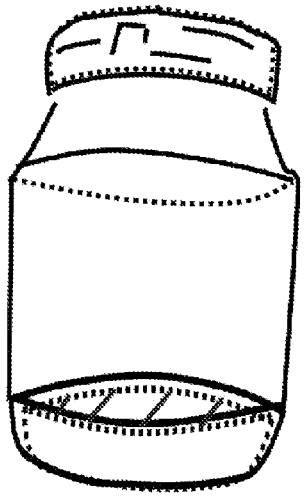
Figure 6C:
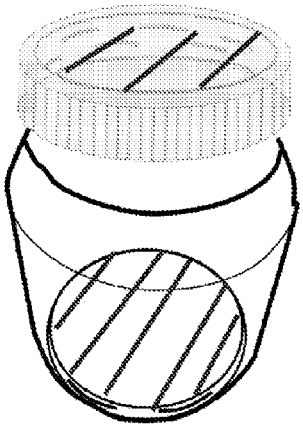

FIG. 6*b* is a side view photo of a wide-mouth plastic jar with an engaged threaded closure FIG. 6*c* is a perspective photo of a wide-mouth plastic jar with engaged threaded closure.

Figure 6D:
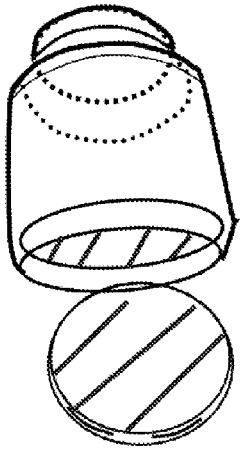

FIG. 6*d* is a perspective photo of a wide-mouth plastic jar with welded interlocking enabled connector. Adjacent to jar bottom is closure with a double wall fastening, including threaded closure for the jar wide-mouth and interlocking connector for interlocking container assembly.

Figure 6E:
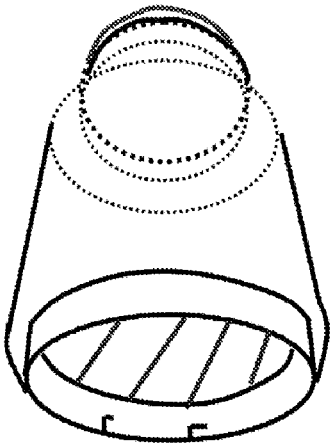

FIG. 6*e* is a perspective photo view of a wide-mouth plastic jar bottom with Interlocking connector.

Figure 6F:
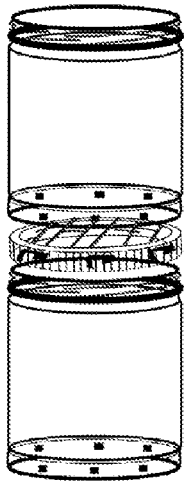

FIG. 6*f* is a side view photo of two wide-mouth plastic jars interlocked as an assembly.

Figure 7:
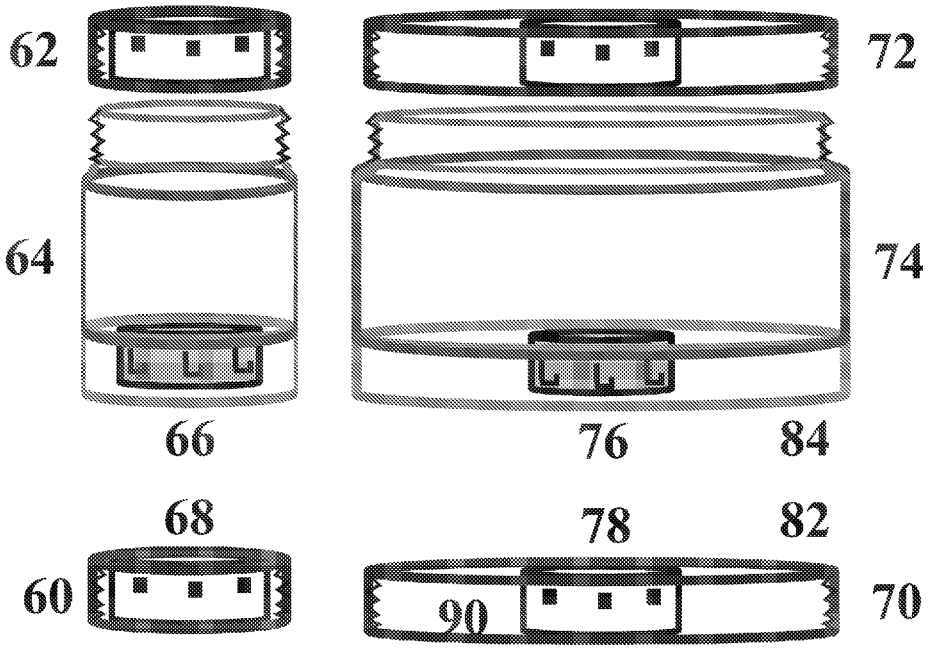

FIG. 7 is an additional embodiment perspective layout view of a common sized interlocking connector mating with different sized container bodies. Diameters or girths of small, medium, large, and in-between body sized containers can mate each other with common sized CRC male and female connectors.

Figure 8:
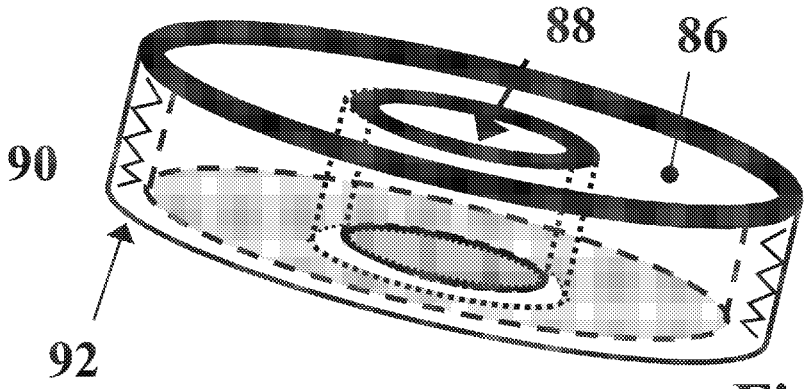

FIG. 8 is a perspective view of a threaded screw-on closure with a common sized interlocking CRC receptor in the top portion of the closure.

Figure 9:
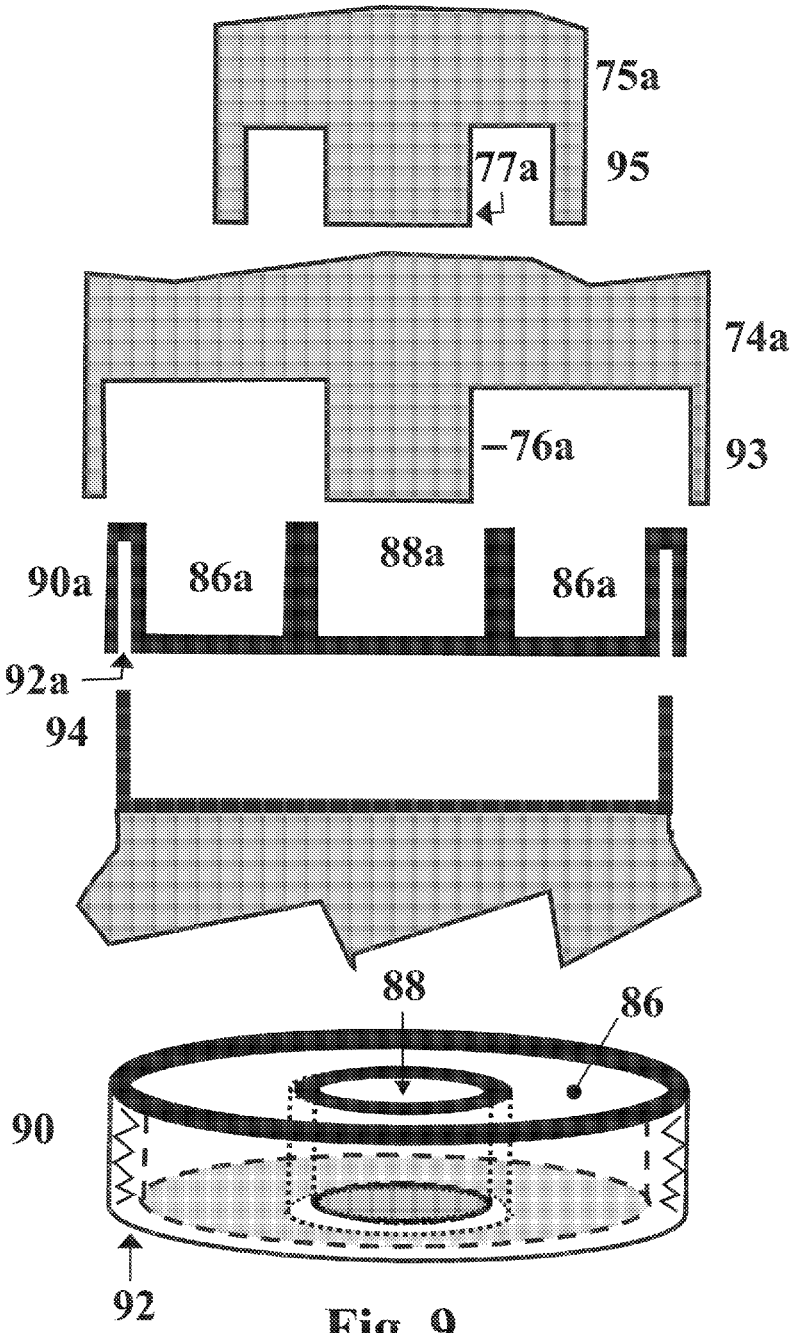

FIG. 9 is a cross sectional profile view of both threaded closure and interlocking container assembly joints with use of a common sized interlocking CRC fastener.

Figure 10:
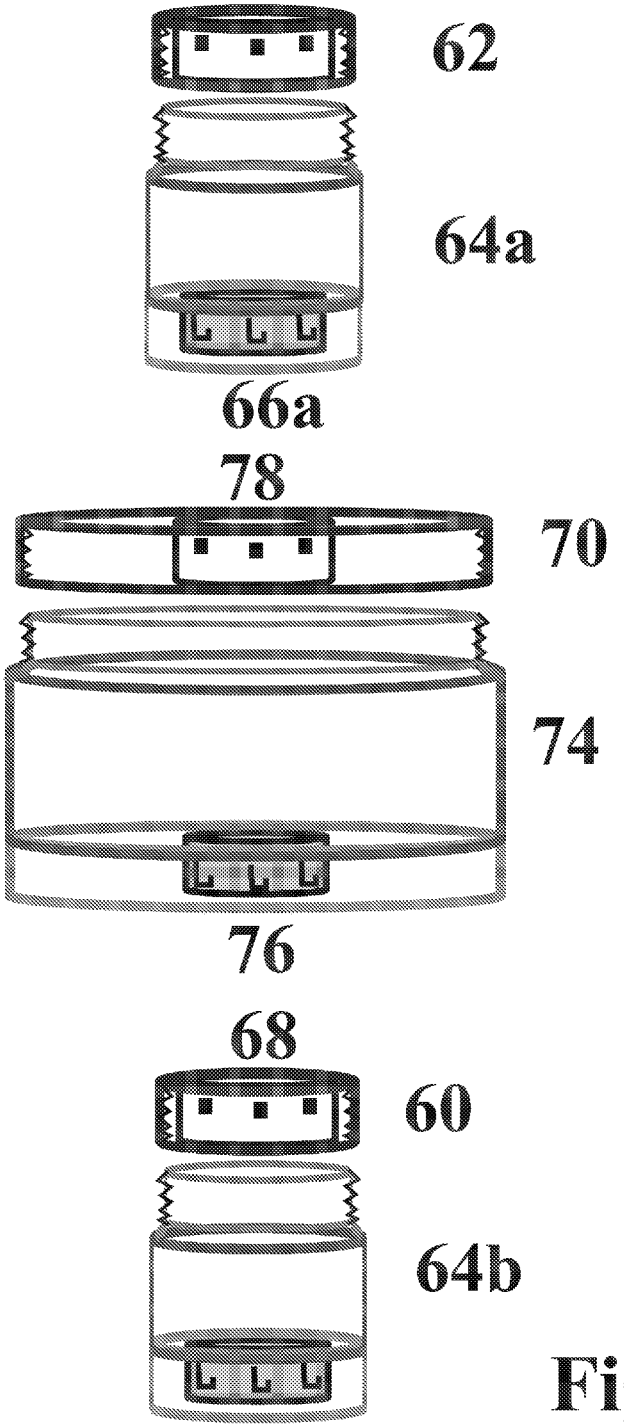

FIG. 10 is an assembly view of different sized containers mating with a common sized interlocking CRC connection.

Figure 11:
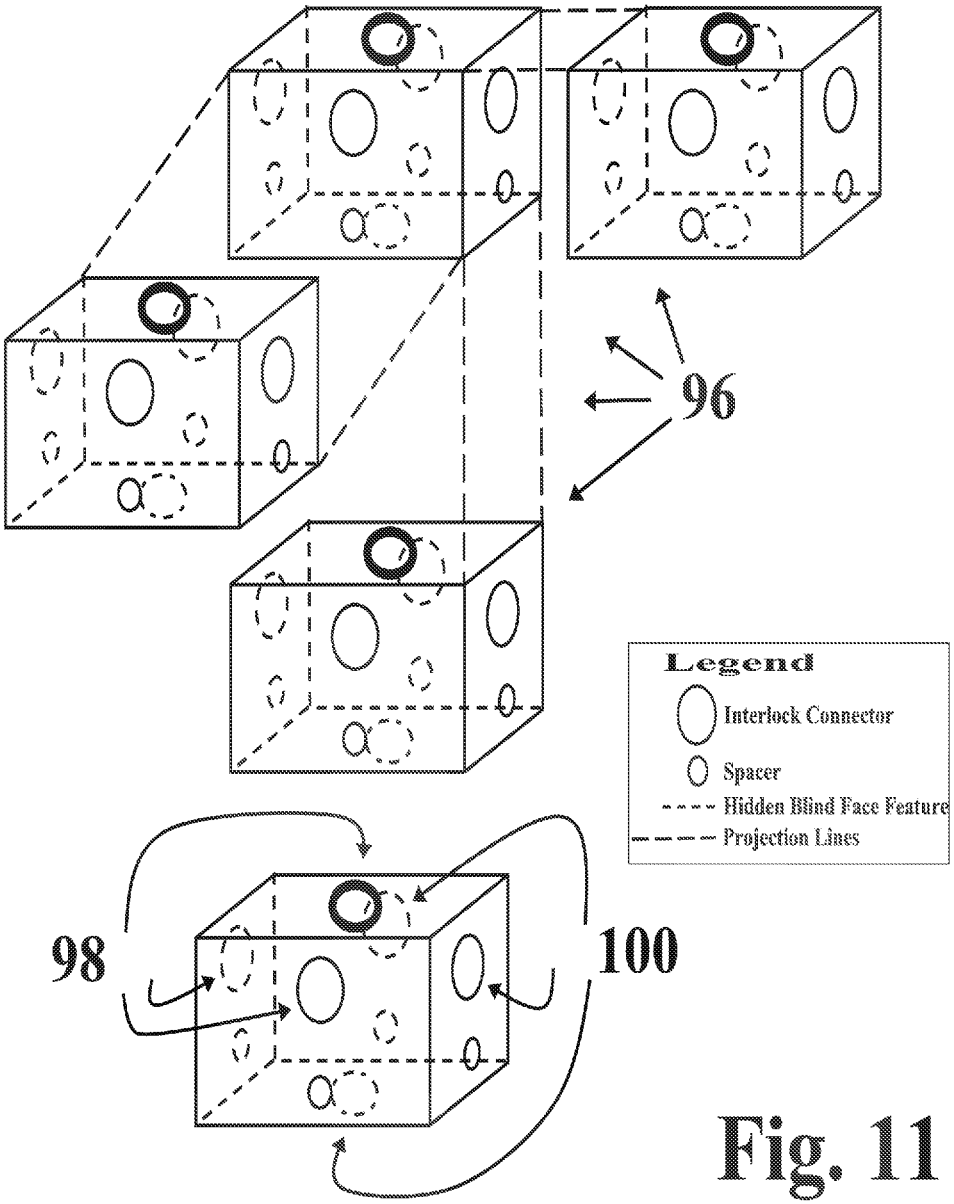

FIG. 11 is an assembly layout for containers mating within a matrix assembly. For each of three faces of a container with a male interlocking connector, the opposite side has a female interlocking connector. Male connectors mate with female connectors.

Figures 12, 13:
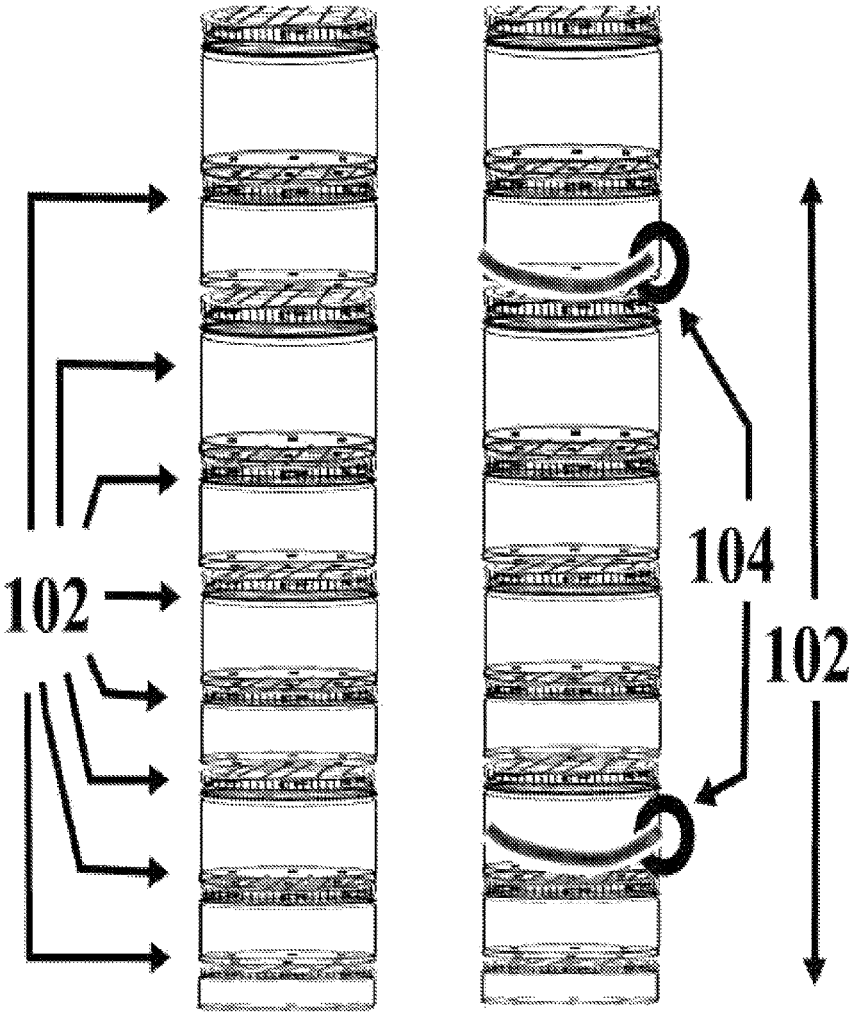

FIG. 12 is representative of an interlocking container assembly of wide mouth jars.

FIG. 13 is a representative interlocking container assembly of wide mouth jars. The assembly is wrapped with two loop straps each holding a carrier ring.

Figure 14B:
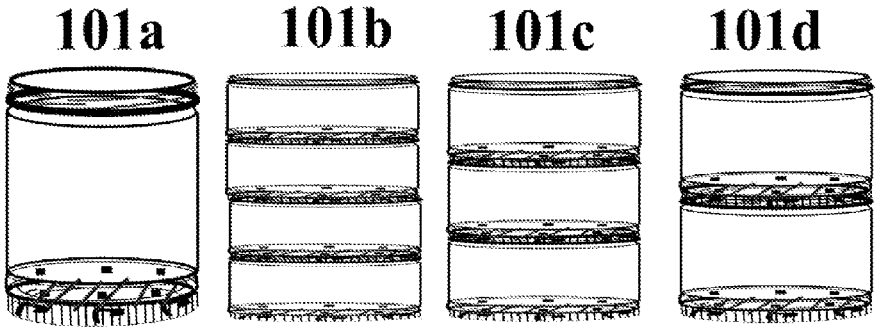
Figure 14A:
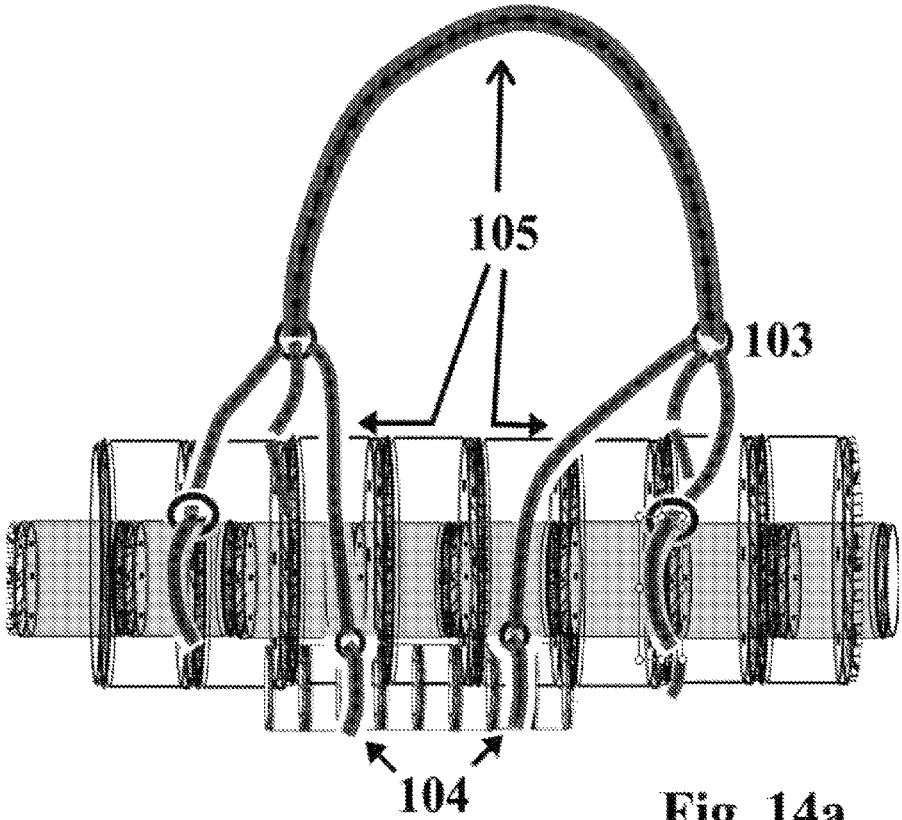

FIG. 14*a* is representative of interlocking containers of three assemblies held adjacent to each other with loop strap carriers, which collectively are held together by a common shoulder carrier strap. Interlocked assembly profiles are highlighted for picture clarity.

FIG. 14*b* is a representative view of a Full Height container adjacent to interlocked container assemblies of equivalent Full Height.

Figure 15:
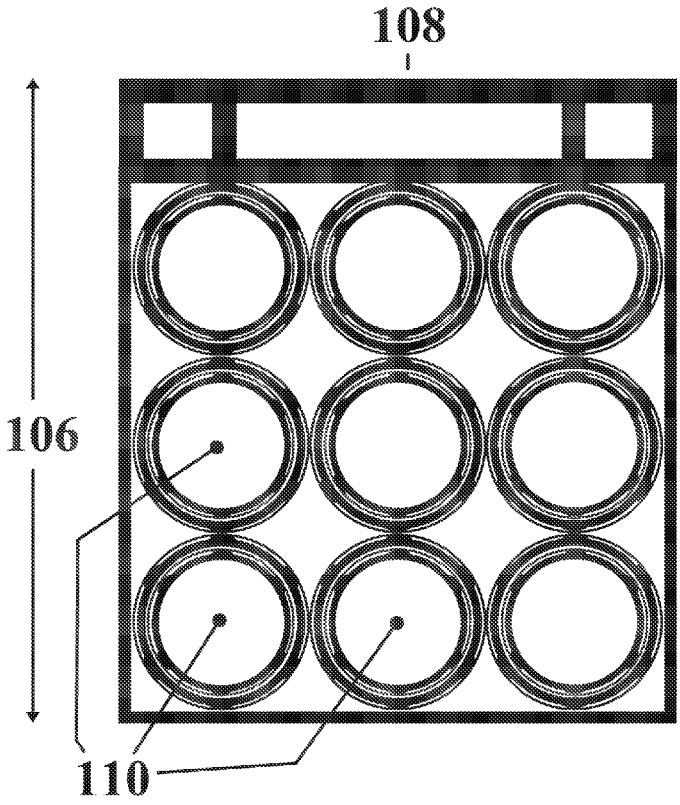

FIG. 15 is a top view of an apparatus holder tray with twelve circular interlocking CRC connectors as individual mates, each to a connection hub.

Figure 16:
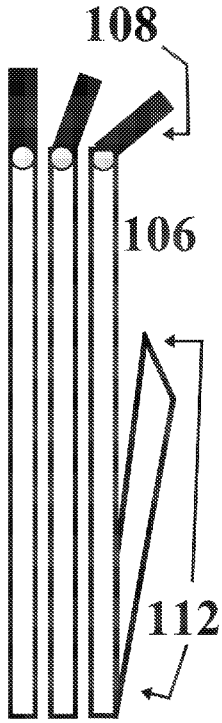

FIG. 16 shows sequenced side views of an apparatus holder tray, with a swivel handle and folding leg bracket.

Figure 17:
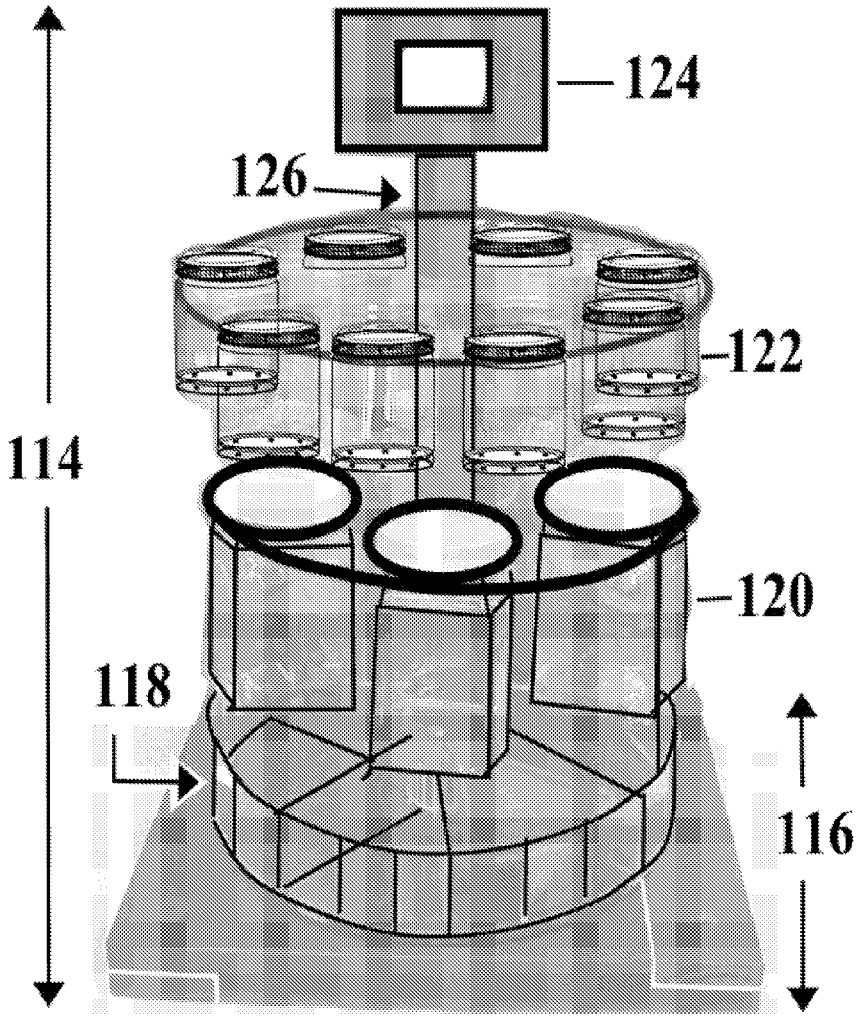

FIG. 17 is a photo of a carousel stand or tote tree with a base, lower rotating tray, two rotating jar holding carousel disks, and a handle.

Figure 18:
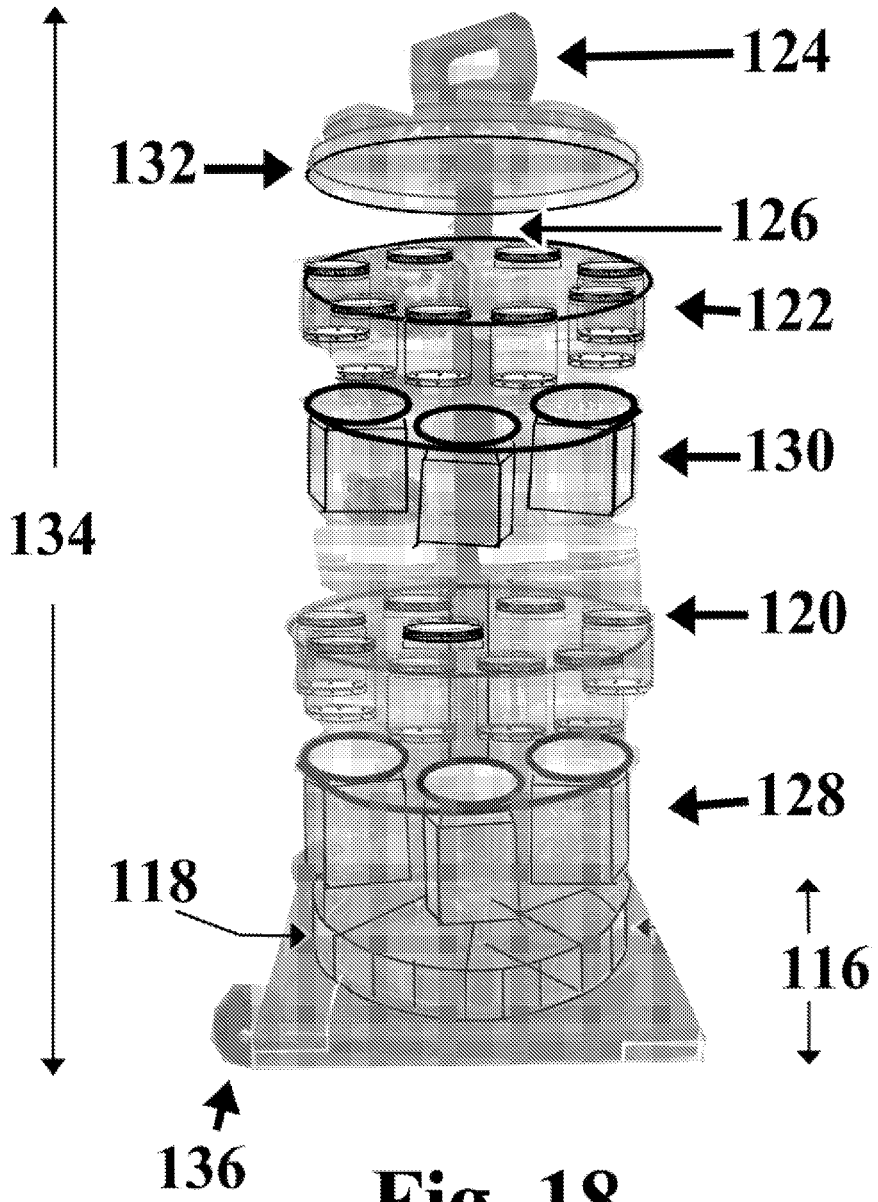

FIG. 18 is a photo of a taller carousel stand with a two-wheel rolling base, lower rotating tray, four rotating jar holding carousel disks, an upper rotating tray, and a handle as the top most member.

FIG. 19 is a representation of a carousel stand for the benchtop. The carousel stand expands by adding modular carousel stand components for a controlled expansion in both vertical and horizontal directions, while maintaining level incremental tiered growth and load balance.

Figure 20:
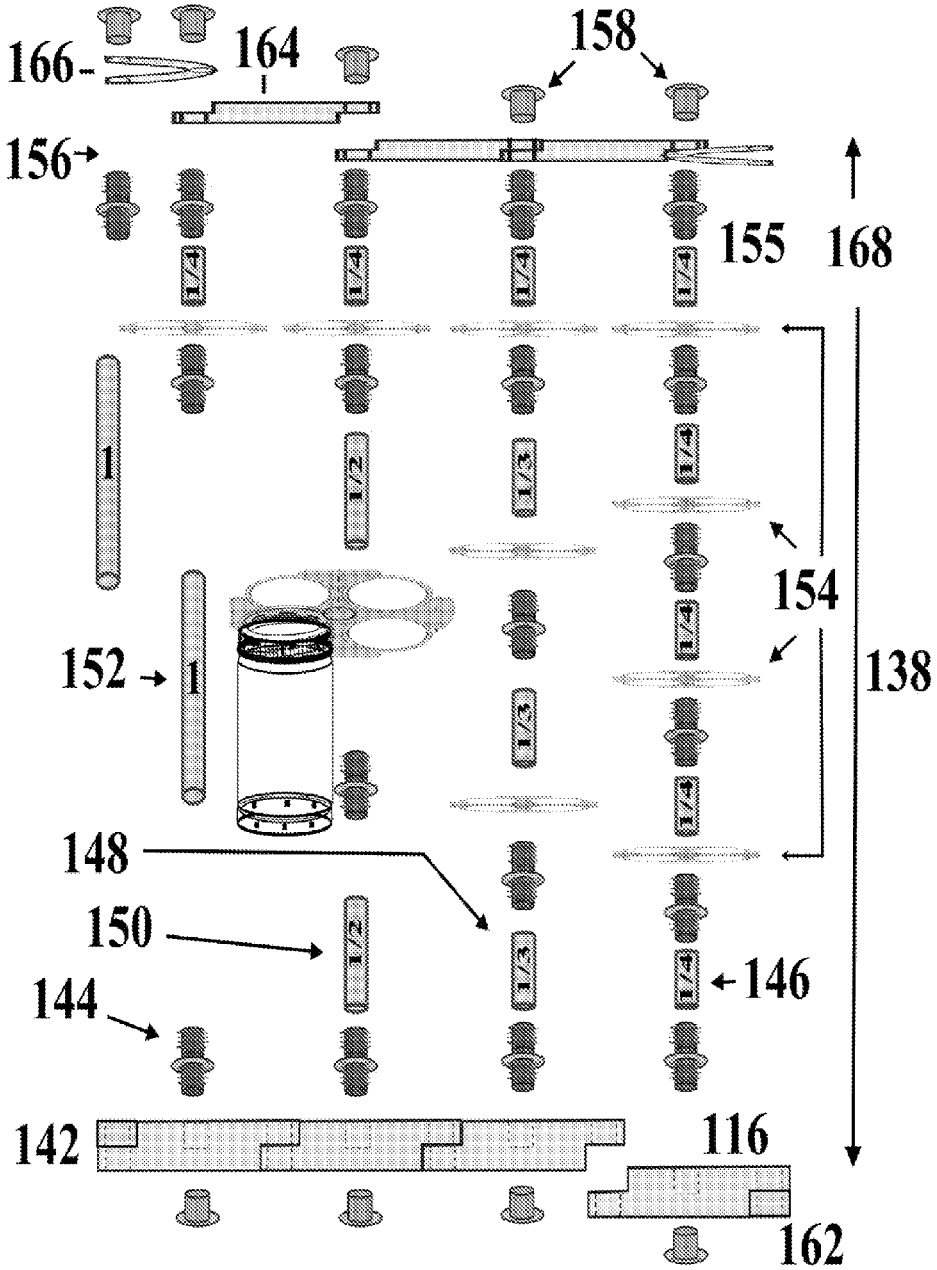

FIG. 20 is an assembly view with component layout of a carousel stand. Expansion is modular and in integral vertical growth dimensions of ¼, ⅓, ½, and full height increments. Modular expansion is also sized to accommodate incremental horizontal growth.

FIG. 21 is a top view of a carousel stand with modular base plates, modular brace support plates, support holes, and support poles.

FIG. 22 is a top view of four equal diameter carousel disk container holders, with layouts for four different diameter sized containers.

FIG. 23 is a top composite view of a Carousel Stand from FIG. 21 and FIG. 22.

DESCRIPTION

FIGS. 1-6*f* Preferred Embodiment

Figure 1:
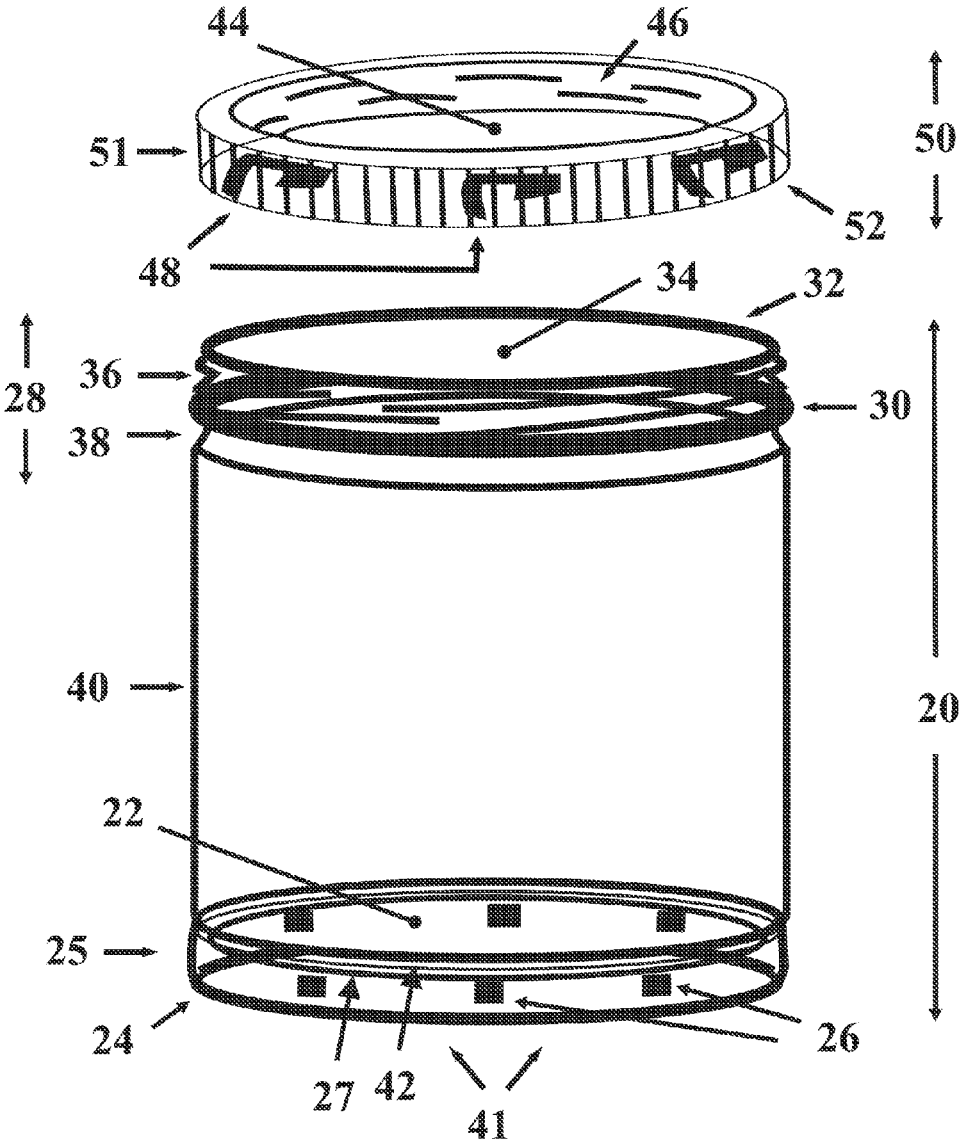
FIG. 1 is a perspective view of the preferred embodiment of a container and closure.

FIG. 1 is a perspective view of my storage system solution's preferred embodiment of a container and closure design. A Container Jar 20 includes an Open Wide-Mouth Top 34, clear round or square plastic Container Body Wall 40, and annular Base Bottom Outer Rim 24. Container Jar 20 has storage space enclosed by a Jar Closure 50.

An annular Base Bottom Outer Rim 24 is the bottom edge to an annular Jar Base Wall 25. This cylindrical structure is connected to an exterior Jar Closed Bottom 22. Together, the exterior Jar Closed Bottom 22, Jar Base Wall 25, and annular Base Bottom Outer Rim 24 form an External Base Cup 41, concave cavity, or upside-down well.

Interlocked stacking of a plurality of Container Jar 20 closed with Jar Closure 50 storage unit is accomplished with Child-Resistant-Closure (CRC) fastening.-Within External Base Cup 41 is positioned a Spring CRC Insert 42 and a plurality of a Base CRC Male Tab 26. Spring CRC Insert 42 is a convex circular disk held in place against Jar Closed Bottom 22, by its edge resting along a smaller diameter raised Insert Rim 27 for a snap-fit. Pressing against Spring CRC Insert 42 causes the convex shaped plastic circular disk to provide a spring force resistance when the plastic is flexed.

Evenly spaced circumferentially around the interior Jar Base Wall 25 is a plurality of Base CRC Male Tab 26. Base CRC Male Tab 26 engages with a Closure External Wall CRC Female Hook 48 to form the interlocking assembly connection or securely locked stacking joint. Base CRC Male Tab 26 is a square like raised projection from the internal Jar Base Wall 25. The horizontal placement of Base CRC Male Tab 26 along Jar Base Wall 25 is determined by the proper desired interaction of Jar Closure 50 top surface pushing against Spring CRC Insert 42 to create a load force or spring like action.

FIG. 2 is a bottom view of External Base Cup 41. The inner Jar Base Wall 25 houses the plurality of Base CRC Male Tab 26 closer to the depth of Base Bottom Outer Rim 24 than to the depth of Jar Bottom 22. Deeper into External Base Cup 41 is the raised Insert Rim 27 which is spaced far enough off of Jar Bottom 22 to house the thickness and retain by smaller diameter, the larger diameter Spring CRC Insert 42.

In FIG. 1 a CRC locking motion typically requires two or more non-redundant motions to disengage. This storage system solution's preferred embodiment is a compression push and a twist. The horizontal placement of the annular plurality of Base CRC Male Tab 26 along Jar Base Wall 25 is determined by the proper parts location alignment to achieve this interlocking engagement of Base CRC Male Tab 26 with Closure Exterior Wall CRC Female Hook 48.

For comparison, the linear motion of forcing a user's hands together creates a compression force.

Container Body Wall 40 is a round cylindrical or square body tube connected to Jar Closed Bottom 22 to form the storage space for the jar's contents. Connected to the opposite end of Container Body Wall 40 are a Jar Neck 28 and circular Open Wide-Mouth Top 34.

More specifically, from Container Body Wall 40, Jar Neck 28 starts with an Annular Recess Jar Neck 38 that is a sloped wall from the larger diameter Container Body Wall 40 to the smaller diameter base of a Raised Collar Neck 30. Raised Collar Neck 30 is a larger diameter annular bead or body rim compared to the diameter of lower positioned Annular Recess Jar Neck 38 and to the diameter of a higher positioned Exterior Jar Neck Threads 36. Raised Collar Neck 30 may sit or seat on the support arms of a holding apparatus finger-like device or annularly slotted disk.

Exterior Jar Neck Threads 36 is for closure fastening and connects Raised Collar Neck 30 to a Jar Top Rim 32.

Jar Closure 50 is similar in shape to an upside-down circular tray; and presents secure fastening for both Container Jar 20 closing and interlocking container assembly. A lower Jar Closure Lip 52 connects to a cylindrical Closure Wall 51. Closure Wall 51 connects to the circular plane of a Closure Top Exterior Surface 44 to form a closed-top lid shape.

Jar Closure 50 seals or closes Container Jar 20 with a Closure Interior Wall Threads 46 mating with Exterior Jar Neck Threads 36. Lid or Jar Closure 50 and Exterior Jar Neck Threads 36 are of sufficient wall height for a secure screw-on engagement thread count.

Evenly spaced circumferentially around the exterior Closure Wall 51 is plurality of Closure Exterior Wall CRC Female Hook 48 to match the spacing pattern of Base CRC Male Tab 26. Closure Exterior Wall CRC Female Hook 48 is a raised or embossed shape of a fish hook that wraps around the square like raised or embossed Base CRC Male Tab 26, on three of four sides for a hooked engagement. Exterior Wall CRC Female Hook 48 is of sufficient small leg and large leg hook height to engage and lock Base CRC Male Tab 26 square height. The longer leg hook prevents an over twist movement, which would result in interlocking disengagement. Exterior Wall CRC Female Hook 48 long leg height is short enough to fit on the height of Closure Wall 51.

FIG. 3 is a bottom inside view of Jar Closure 50. A clear solid surface is the preferred embodiment for a Closure Top Interior Surface 54. Along the exterior of Closure Wall 51 is the circumferentially evenly spaced Closure Exterior Wall CRC Female Hook 48. Along the interior of Closure Wall 51 is Closure Interior Wall Threads 46. The preferred embodiment of the center top of Jar Closure 50 is a transparent surface for quick visual identity of the container's content. Further, Closure Wall 51 as a plastic can be color coded for sorting and rapid identification when among many other Jar Closure 50 different color coded Closure Wall 51.

In FIG. 1 Jar Closure 50 with Container Jar 20 operation and performance includes significant functionalities.

A single Jar Closure 50 with Container Jar 20 as a unit may function as a standalone jar container. A Level plane at highest top and lowest bottom, edge or surface, of both Jar Closure 50 and Container Jar 20 enable freeform stacking and nesting of open or closed storage units, and a balanced container load results.

With threaded sealed Jar Closure 50 and Container Jar 20 closed storage units, each unit's top and bottom perform as one mate of a two mate interlocking container assembly connection hub. Exterior Wall CRC Female Hook 48 mates with Base CRC Male Tab 26.

A single twist action causes the plurality of equally spaced Base CRC Male Tab 26 to ride along the down slope of the short legs hook end, while depressing Spring CRC Insert 42. When Base CRC Male Tab 26 is twisted past the sloped end of the short hook leg it pops into Exterior Wall CRC Female Hook 48 three-sided well. One container is now interlocked with another container.

To disengage this interlocking connection requires a forced compression of Spring CRC Insert 42 while simultaneously twisting Jar Closure 50 and Container Jar 20 in opposite rotation to the direction for engagement. This dual motion force requires a controlled and planned motion to perform the disengagement. This is significant because the interlocking container assembly motion does not duplicate the motion required to disengage the threaded closure seal of Jar Closure 50 with Container Jar 20.

CRC Alternative

For an even more secure interlocking container assembly connection a third simultaneous motion or force could be required such as a radially inward depressing force of a thumb locking tab along Closure Lower Lip 52, while depressing Spring CRC Insert 42 and twisting. Anatomically, this would require a hand grasp of Closure Lower Lip 52 with thumb on thumb-locking-tab and the rest of the same hand wrapping and grasping the opposite edge of same Closure Lower Lip 52. Then, with opposite hand grasping Container Body Wall 40 of the adjacent upper Container Jar 20, the lower Container Jar 20 is disengaged with a thumb press, and controlled compression force between the hands and a twist motion.

As one skilled in the art will appreciate, containers can be made of plastic, paper, metals, ceramics, glass and other materials.

Plastic containers are produced by means of blow molding, injection molding, and two or more part weldment. Blow molding is a technique for making hollow objects, such as bottles, by injecting air under pressure into a molten mass of glass or plastic and shaping the object within a mold. Injection molding is a manufacturing process for forming objects, as of plastic or metal, by heating the molding material to a fluid state and injecting it into a mold.

With some container profiles, it is difficult to produce a finished part with a single mold and process. These container profiles may be produced by welding two or more parts together for a finished single piece. Weldments of compatible materials are performed by the application of heat or chemical reaction.

Figure 4:
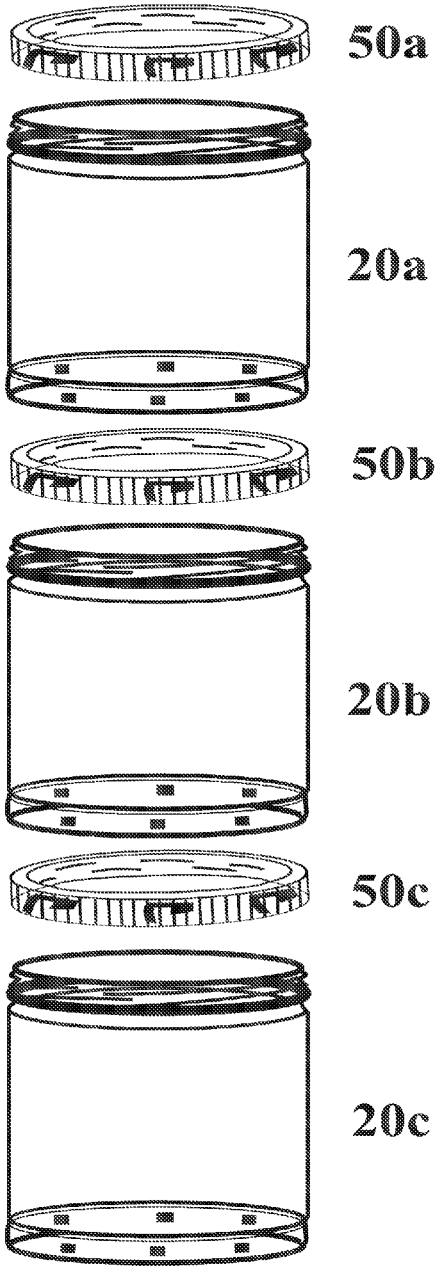
FIG. 4 is an assembly view of an interlocking container assembly.

FIG. 4 is an assembly view of the placement and alignment of an interlocking container assembly. An Upper Jar Closure 50*a* threading seals an Upper Container Jar 20*a*. This is a complete container storage unit with closed lid. A Middle Jar Closure 50*b* threading seals a Middle Container Jar 20*b*. This is a complete container storage unit with closed lid. A Lower Jar Closure 50*c* threading seals a Lower Container Jar 20*c*. This is a complete container storage unit with closed lid.

For a three unit interlocking container assembly Middle Jar Closure 50*b* is interlocked with Upper Container Jar 20*a* and Lower Jar Closure 50*c* is interlocked with Middle Container Jar 20*b*. The three unit interlocking container assembly is complete. One can easily envision the extension of this interlocking container assembly with the locked assembly of a plurality of individual storage container units.

Figure 5:
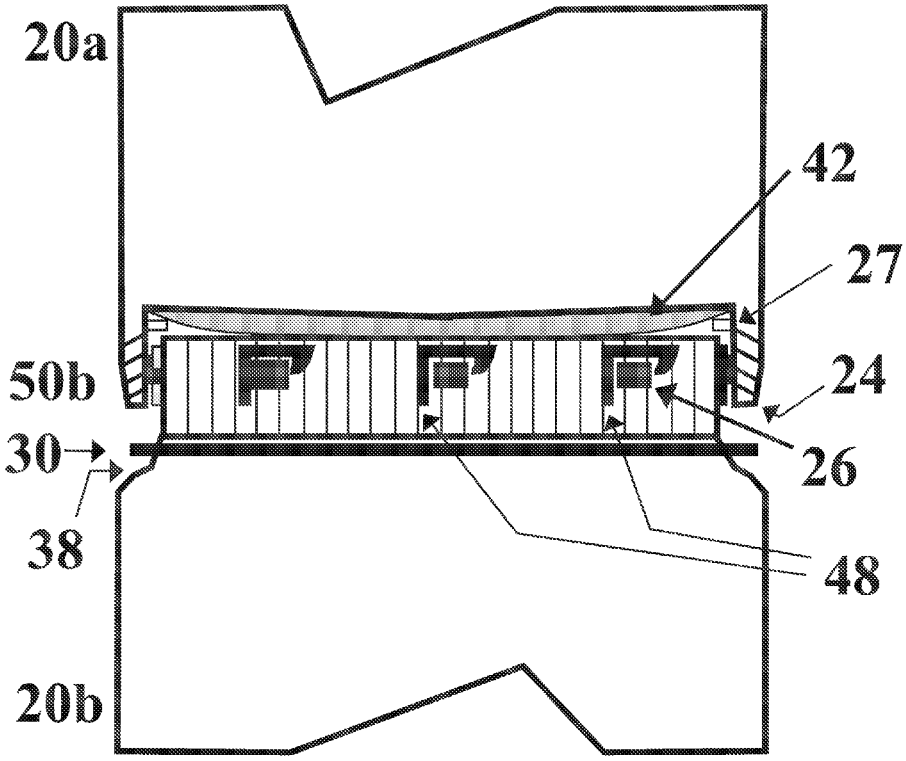
FIG. 5 is a cut-away view of a CRC closure connector mated to a CRC jar bottom. This represents a connection hub.

FIG. 5 is a cutaway view of an interlocked container assembly connection for wide mouth jar containers. Middle Jar Closure 50*b* threading seals Middle Container Jar 20*b*. This is a complete container storage unit with closed lid. Upper Container Jar 20*a* has Base CRC Male Tab 26 interlocked connected to Middle Jar Closure 50*b* by hook fastening with Closure Exterior Wall CRC Female Hook 48.

Spring CRC Insert 42 is held in place by Insert Rim 27. Base Bottom Outer Rim 24 is of sufficient distance above the lower body wall of Middle Jar Closure 50*b* to permit finger manipulation of parts for disengagement.

Raised Collar Neck 30 is of sufficient diameter and Annular Recess Jar Neck 38 spacing allowance means, to permit the mechanical holding of Middle Container Jar 20*b* by resting Raised Collar Neck 30 above mechanical grasp finger holding apparatus devices such as a carousel disk with annular slots.

Prototype Model

FIGS. 6*a*-6*f* are photos of prototype plastic wide-mouth jars. As described earlier, the preferred embodiment of my storage system solution is CRC fastening with two or more motions to disengage the interlocked container assembly. Because of prototype expense considerations, these models were made with threaded interlocking container assembly connections. This threaded connector provides an interlocking container assembly but the disengaging rotation movement is redundant to the rotation disengagement of a threaded jar lid closure. The reader should be able to make the virtual substitution of CRC enabled fastening for the threaded interlocking container assembly connector to achieve the true spirit of my storage system solution.

For presentation purposes, the reader will see visual representations of Base CRC Male Tab 26 and Exterior Wall CRC Female Hook 48 in the photos of FIGS. 6*b*, 6*c*, 6*d*, and 6*e*. Also the printed wording "Clear Center" in FIGS. 6*c* and 6*d* are on the Prototype Jar Closure 176 to represent the preferred embodiment of my storage system solution of a clear lid center with color coded lid rims.

Continuing, FIG. 6*a* is a front view photo of a Wide-Mouth Clear Plastic Jar 175 with an interlock-thread fastening enabled Welded Jar Bottom 174. In the top of the picture, Exterior Jar Neck Threads 36 is resting on Prototype Jar Closure 176.

FIG. 6*b* is a side view photo of a prototype Wide-Mouth Clear Plastic Jar 175 with a threaded closure. Prototype Jar Closure 176 threading seals or closes Wide-Mouth Clear Plastic Jar 175. Welded Jar Bottom 174 is attached to the bottom of Wide-Mouth Clear Plastic Jar 175.

FIG. 6*c* is a perspective top view photo of Wide-Mouth Clear Plastic Jar 175 with threading closed Prototype Jar Closure 176.

FIG. 6*d* is a photo of Wide-Mouth Clear Plastic Jar 175 with Welded Jar Bottom 174 that has interlock-thread fastening enabled connector. Adjacent to Wide-Mouth Clear Plastic Jar 175 is Prototype Jar Closure 176 that has double wall fastening, with interior threaded closure for the jar mouth and exterior interlock-thread fastening connector for interlocked container assembly.

FIG. 6*e* is a bottom perspective photo view of Wide-Mouth Clear Plastic Jar 175 bottom with Welded Jar Bottom 174 and an interlock-thread fastening connector.

FIG. 6*f* is a front view photo of two wide-mouth plastic jars interlock-thread fastening as an assembly. Upper Wide-Mouth Clear Plastic Jar 175 with Welded Jar Bottom 174 is interlock-thread fastening connector enabled. A Lower Jar 178 is sealed with Prototype Jar Closure 176. Prototype Jar Closure 176 is interlock-thread fastened as assembled within Welded Jar Bottom 174.

FIGS. 6*a*-6*f* also demonstrate the feasibility of design for parts clearances. For comparison, the raised protrusion of CRC tabs and hooks is not significantly greater than the protrusion of my interlock-thread fastening.

FIGS. 7-11 Additional Embodiment

Common Sized CRC Stud and Receptor

FIGS. 7, 8, 9, and 10 show an alternative interlocking container assembly embodiment where the Child-Resistant Closure (CRC) fastening for interlocking container assembly is a common-sized mating connection regardless of the girth or diameter of the container. This enables container bottom and closure top CRC enabled mating connections to mate with any other body size. Any size body and mated closure storage unit, within an interlocked container assembly, has a common sized female CRC connection and a common-sized male CRC connection.

FIG. 7 is a front view of two different sized containers each with a threaded closure appropriately matched in size to seal or close an individual storage unit. A Small Body Jar 64 seals or threading closes with an Upper Small Closure 62. A Large Body Jar 74 seals or threading closes with an Upper Large Closure 72.

Within the external base concavity resides a Small Jar Common size Male CRC Stud 66. Below Small Jar Common size Male CRC Stud 66 is shown a Lower Small Closure 60 housing a Small Jar Common Size Female CRC Receptor 68. Upper Small Closure 62 may be equal in size to Lower Small Closure 60. Assume Lower Small Closure 60 seals or threading closes a virtual container similar in size to Small Body Jar 64. Now, you are able to CRC interlock container assemble Small Jar Common size Male CRC Stud 66 into Jar Common Size Female CRC Receptor 68, as you build your assembly. CRC mating methodology may be similar to the earlier detailed description of a female CRC Hook wrapping around or hooking a male CRC tab.

Similarly with Large Body Jar 74, within the external base concavity resides a Large Jar Common size Male CRC Stud 76. Below large Jar Common size Male CRC Stud 76 is shown a Lower Large Closure 70 housing a Large Jar Common Size Female CRC Receptor 78. Upper Large Closure 72 may be equal in size to Lower Large Closure 70. Assume Lower Large Closure 70 seals or threading closes a virtual container similar in size to Large Body Jar 74. Now, you are able to CRC interlock container assemble Large Jar Common size Male CRC Stud 76 into Large Jar Common Size Female CRC Receptor 78, as you build your assembly. CRC mating methodology may be similar to the earlier detailed description of a female CRC hook wrapping around or hooking a male CRC tab.

Within an interlocking container assembly, a Large Jar Base Rim 84 fits annularly around a Large Closure Upper External Rim 82.

Small Jar Common size Male CRC Stud 66 is equivalent in size to Large Jar Common size Male CRC Stud 76. Small Jar Common Size Female CRC Receptor 68 is equivalent in size to Large Jar Common Size Female CRC Receptor 78. This common sized male stud fasteners and common-sized female receptors enable compatible interlocking container assembly of jar or container bodies of different sizes, girths, shapes, or diameters.

FIG. 8 presents a more detailed view of a Large Closure with Common Sized CRC Receptor 90. Within the exposed top of Large Closure with Common Sized CRC Receptor 90 resides a Large Closure Recess 86. Large Closure Recess 86 surrounds a Large Closure CRC Receptor Well 88. In FIG. 7, Lower Large Closure 70 may be similar in size to FIG. 8

Large Closure with Common Sized CRC Receptor 90. In FIG. 7, Large Jar Common Size Female CRC Receptor 78 is equivalent in size to FIG. 8 Large Closure CRC Receptor Well 88. FIG. 8 further shows a Large Closure Threaded Annular Well 92 or circular recess that is exposed at the bottom of the closure. Large Closure Threaded Annular Well 92 houses the threads to seal or threading close the container.

FIG. 9 provides greater detail with a cut-away view of the mating profiles of a common-sized CRC connector stud mating into a common-sized CRC connector receptor, for mating a large to small body container unit. As earlier, Large Closure with Common Sized CRC Receptor 90 has Large Closure Recess 86 surround housing Large Closure CRC Receptor Well 88. Also, on opposite side of lid or closure, Large Closure Threaded Annular Well 92 houses threads to seal or threading close a large container.

FIG. 9 block diagram mating contour for a Profile of Large Closure with Common Sized CRC Receptor 90*a* is similar to profile for Large Closure with Common Sized CRC Receptor 90. For container seal or threading closure, a Profile Large Jar Threaded Neck and Rim 94 screws into a matched bottom Profile Large Closure Threaded Annular Well 92*a*.

Top of Profile Large Closure with Common Sized CRC Receptor 90*a* mates with the base contour of either a Profile Large Body Jar 74*a* or a Profile Small Body Jar 75*a*. This mates a large or small body jar with common-sized CRC stud into the same common-sized CRC receptor.

Specifically, for large container to large closure mating (Profile Large Body Jar 74*a* mating Profile Large Closure with Common Sized CRC Receptor 90*a*), a Profile Large Jar Common size Male CRC Stud 76*a* cylindrical stud CRC mates into slightly larger diameter cylindrical well a Profile Large Closure CRC Receptor Well 88*a*. And, a Cylindrical Large Base Wall 93 wraps around the exterior of Profile Large Closure with Common Sized CRC Receptor 90*a*.

Further, for small container to large closure mating (Profile Small Body Jar 75*a* mating Profile Large Closure with Common Sized CRC Receptor 90*a*), a Profile Small Jar Common size Male CRC Stud 77*a* cylindrical stud CRC mates into slightly larger diameter cylindrical well Profile Large Closure CRC Receptor Well 88*a*. And, a Cylindrical Small Base Wall 95 sits within a Profile large Closure Recess 86*a*

FIG. 10 is an assembly view of two small container interlocking container assembled to a large container by means of common-sized CRC connections. Lower Large Closure 70 seals or threading closes Large Body Jar 74. Lower Small Closure 60 seals or threading closes a Lower Small Jar 64*b*. Likewise, Upper Small Closure 62 seals or threading closes an Upper Small Jar 64*a*. We now have three closed storage containers.

For interlocking container assembly, a Small Jar CRC Stud 66*a* interlocks into Large Jar Common Size Female CRC Receptor 78. Large Jar Common size Male CRC Stud 76 interlocks into Small Jar Common Size Female CRC Receptor 68. We now have three closed storage containers securely stacked into an interlocking container assembly.

Additional Embodiment

Matrix

FIG. 11 is an assembly view perspective of a three-dimensional orthogonal interlocking container assembly or a Container Matrix Assembly 96. This represents my storage system solution's broader embodiment of individual re-closable multi-sided container units, three-dimensional orthogonals, or boxes connected into an interlocking container assembly to form a matrix structure. With a multi-sided container, specifically six sides in this example, one or more of the sides may provide a re-closable secure seal, for example a threading closure. Then, three sides not opposite to each other, or three adjacent sides are chosen to house a Male CRC Interlocking Connector 98. The three remaining sides, one of which each is opposite side to the first chosen sides, house a compatible Female CRC Interlocking Connector 100.

Container Matrix Assembly 96 is interconnected with different motion interlocking connections like a push and twist CRC connector versus a threading closure seal. This matrix interlocking motion is unique compared to the fastening mechanism chosen for each re-closable container opening. On each side or orthogonal face, spacing bubbles or convex bumps can be spaced around each Male CRC Interlocking Connector 98 and each Female CRC Interlocking Connector 100 to offset faces from one another when in Container Matrix Assembly 96, to provide human hand operating space to manipulate the connector for engagement and disengagement.

A matrix interlocking structure may require more than one interlocking connection per container. To provide for the rotation of a coupling hub in a plurality of different planes may require that the coupling hubs are rotationally enabled, independent of the container body's rotation or linear movement. With this design, a plurality of CRC couplings per container may be rotated for engagement or disengagement without spatial movement of the hosting container body.

Similarly, the linear compression force for CRC disengagement of interlocking container's within a matrix may also be independent of the host container body's movement. Thus, CRC matrix connector hubs would rotate and slide linearly independent of the host container body's movement.

FIGS. 12-23 Additional Embodiment with Holding Apparatus

We will now focus on my storage system solution's plurality of container holding apparatus, jigs, fixture devices and equipment. The quick and secure interlocking container assembly fastening of my storage system solution provides a means for assembling a single re-closable container into a plurality of interlocked containers performing as a common carrying stack or matrix. Each interlocking container to holding apparatus connection is at a connection hub similar to the connection hub between two interlocking container. This combined interlocking container assembly and holding apparatus is a means for controlled and safe transport of all containers and their contents.

Shoulder Harness

FIG. 12 shows a perspective view of an Interlocking Jar Container Assembly 102. In my storage system solution's preferred embodiment, this is a securely interlocking container assembly or jar column ready for transport.

FIG. 13 Interlocking Jar Container Assembly 102 is wrapped by two Looped Strap with Carrier Ring 104. Each loop strap is buckled, hook and loop, snap fitted, or other means snug fit tight with a strap around the assembly structure. Each strap has a ring attached for holding. Preferably the straps and rings are placed and spaced on Interlocking Jar Container Assembly 102 in annular positions to aid in balancing the interlocked stack load during transport.

FIG. 14*a* shows the transport means of a plurality Looped Strap with Carrier Ring 104 assemblies, enhanced with the collective transport aid or holding device of a Shoulder Harness Strapping 105 that is held in hand or "thrown over user's shoulder", as the carrier vehicle. Shoulder Harness Strapping 105 connects to a plurality of Carrier Ring for Shoulder Harness 103. Carrier Ring for Shoulder Harness 103 is attached by a plurality of strapping tentacles to Looped Strap with Carrier Ring 104. Together, this shoulder harness strapping transport system is a quick, light weight, and inexpensive means to transport a plurality of Looped Strap with Carrier Ring 104 assemblies. The strapping can be made from fabrics or plastics, natural or synthetic materials, sewn, heat seal hemmed, or adhesive hem bound. Carrier rings material may be plastic, metal, ceramics, or composite materials. Preferably the straps and rings are placed and spaced on the plurality of Interlocking Jar container Assembly 102 in annular positions to aid in balancing the interlocked stack load during transport.

Tote Trays

My storage system solution's interlocking container assembly connectors provide opportunity for a plurality of container holding devices to securely hold a single container or a plurality of interlocked containers for the desired functions of storage and transport. Further, container content presentation, visibility, access, collection, and packaging capabilities are ergonomically enhanced for the user.

FIG. 14*b* is a perspective view of a composite photo that shows the integral growth design concept of planned container sizes to facilitate balanced vertical growth when positioning interlocked container assemblies adjacent to other assemblies, to achieve common heights at level increments. Also, a Full Height Container 101*a* is shown and demonstrates the use of wide-mouth jars, which can facilitate the placement of a hand within the container.

An incremental common heights design provides that Full Height Container 101*a* is equivalent in height to each of Four Interlocked One-Fourth Height Container 101*b*, Three Interlocked One-Third Height Container 101*c*, and Two Interlocked One-Half Height Container 101*d* assemblies.

FIG. 15 shows a top view of a Tote Hanging Tray with CRC Studs 106, which presents a plurality of Male Molded CRC Fastening Studs 110 for interlocked container connection to the plurality of Closure Exterior Wall CRC Female Hook 48 from Upper Container Jar 20*a*, as shown in FIG. 5. In FIG. 15 a Handle and Side Holes 108 is attached to one edge end of Tote Hanging Tray with CRC Studs 106. Handle and Side Holes 108 functions as both a transport handle and a wall hanging hook via the access holes in the handle.

FIG. 16 are sequenced side views of Tote Hanging Tray with CRC Studs 106 from a flat and folded configuration, progressing to the angled Handle and Side Holes 108 and swing down a Folding Angle Leg Bracing 112. Angled Handle and Side Holes 108 with ratcheting index enables a selectable angle of presentation for container contents within containers interlocked to Tote Hanging Tray with CRC Studs 106. Angled presentation is further enhanced, by coordinated placement of Folding Angle Leg Bracing 112 with Handle and Side Holes 108.

Carousel Stand

FIG. 17 is a photo of a Smaller Tote Stand 114. Smaller Tote Stand 114 is a holding and carrier apparatus device for a collection of containers. In FIG. 17 this collection happens to be small round size wide-mouth jars and medium rectangular body sized wide-mouth jars. A Tote Base 116 is the foundation for building a modular assembly of a carousel disk tote stand. Carousel disk are rotating container holding circular trays, disks or flat planes. Varied sized slotted cutouts are positioned around the carousel disk annular edge that fit securely as fingers under Raised Collar Neck 30 and within Annular Recess Jar Neck 38 as presented first in FIG. 1.

An alternative embodiment of the carousel disk removes the slotted finger cutouts and replaces their location with molded CRC Studs similar to the configuration detailed for Tote Hanging Tray with CRC Studs 106 in FIG. 16. The modular design and assembly of a tote stand or tote tree stand is described in greater detail later.

In FIG. 17 from Tote Base 116 center threaded vertical hole, a Tote Stand Pole 126 is threaded together in sectional heights to achieve the overall desired height. The top annular end of each sectional height Tote Stand Pole 126 provides a bearing hub with spacing for resting and rotation of the slightly larger annular bearing hub of a carousel disk container holder. A Bottom Carousel Tray 118 with repositionable divider wall partitions rests on the bearing hub of the top surface to Tote Base 116.

A Medium Jar Size Carousel Disk 120 rests and rotates on the bearing hub of the first Tote Stand Pole 126 threading connected to Tote Base 116. Similarly, a Small Jar Size Carousel Disk 122 rests and rotates on the bearing hub of the next highest threaded Tote Stand Pole 126. Finally, a Tote Stand Handle 124 threading connects to the last threaded Tote Stand Pole 126 connector, for ease of picking up the Smaller Tote Stand 114 for transport.

Carousel disks are show In FIG. 17 with slots. The slots edges fit under Raised Collar Neck 30 from FIG. 1. However, Carousel Disks could just as easily be solid circular disks with raised CRC Studs for connection hubs as described earlier.

FIG. 18 is a photo of a Floor Model Tote Tree Stand 134. Floor Model Tote Tree Stand 134 is a taller version of Smaller Tote Stand 114 but with modular additions of Tote Stand Pole 126 providing a bearing hub for rest and rotation of additional carousel disk container holders.

In FIG. 18 Tote Base 116 is modified by the threading removal of a base spacer bar and its replacement with a Two Wheel Base Attachment 136. Two Wheel Base Attachment 136 provides a rolling means for tilt and push or tilt and pull, of Floor Model Tote Tree Stand 134.

The vertical modular growth or build of Floor Model Tote Tree Stand 134 includes Bottom Carousel Tray 118, and the threading additions of sectional Tote Stand Pole 126 that each provides an annular bearing hub for rest and rotation of the slightly larger annular hub of carousel disks and trays. Specifically, from Tote Base 116 are threading added the sectional Tote Stand Pole 126 and a Large Jar Size Carousel Disk 128; to which are threading added the sectional Tote Stand Pole 126 and Medium Jar Size Carousel Disk 120; to which are threading added the sectional Tote Stand Pole 126 and a Medium-Small Jar Size Carousel Disk 130; to which are threading added the sectional Tote Stand Pole 126 and Small Jar Size Carousel Disk 122; and to which are threading added the sectional Tote Stand Pole 126 and a Top Carousel Tray 132. Finally, the sectional Tote Stand Pole 126 and Tote Stand Handle 124 are added as the top most members for carriage and tilting, for rolling transport.

Modular Carousel Stand for Workbench

In FIG. 17 and FIG. 18, the modular planned growth of Smaller Tote Stand 114 and Floor Model Tote Tree Stand 134 is presented. The same modular component design that builds these stands is used to build a Carousel Stand for the Worktop 138 as in FIG. 19.

FIG. 19 is a perspective view of Carousel Stand for the Benchtop 138. A Character Holding a Container 140 presents the functional utility of a single re-closeable wide-mouth container providing the ability to easily see through the clear plastic container wall structure and top transparent plastic closure to readily identify the container's secure contents.

Behind and above Character Holding a Container 140 is Carousel Stand for the Benchtop 138 that demonstrates the modular design for a controlled, planned vertical and horizontal growth of a stand to store and present for easy access the contents of a plurality of containers. In FIG. 19 we see a plurality of carousel jar holding disks and trays which rest and rotate on bearing hubs of a plurality of vertical pole sectional members which threading connect in planned fractional increments for uniform level growth of tiers. At stand ends, we see vertical support poles for stand stabilization, strength, and rigidity. Finally, we see modular horizontal members of base stands and tier topping brace bars and plates. In FIG. 20 we see this in more detail.

FIG. 20 is a perspective assembly view of a First Tier 168 of Carousel Stand for the Benchtop 138 which houses at planned integral heights a plurality of Carousel Disk Container Holder 154. In this example we show wide-mouth jars.

A Modular Tote Base 142 of a plurality common sized Tote Base 116 are threading connected as a single base assembly by means of a plurality of Threaded Cap 158 fastening through strategically placed plurality of holes of Tote Base 116 to mate with the same plurality of a Threaded Pole Connector 144. Completing Modular Tote Base 142 assembly is at each end a Spacer or Handle Bar 162.

Continuing with FIG. 20, Carousel Stand for the Benchtop 138 vertical growth may occur in planned full height increments by means of a Full Height Spindle Pole 152 length. A Hand Clearance Increment 155, one-fourth in this example, may be added for easier access to open container's contents. Structural support and rigidity may be added by topping of stand tiers with a plurality of a Brace Bar Single Plate 164 which assembles as a Modular Brace Bar 156, similar to Modular Tote Base 142 methodology.

Spindle Pole assembly and growth occurs in planned increment lengths. In this example, a One-Fourth Height Spindle Pole 146, a One-Third Height Spindle Pole 148, and a One-Half Height Spindle Pole 150 combine in mathematically appropriate combinations of threading connection to equal an equivalent height growth of one Full Height Spindle Pole 152. For example, two One-Half Height Spindle Pole 150, and four One-Fourth Height Spindle Pole 146 each equate to the equal growth height of one Full Height Spindle Pole 152.

This incremental growth pattern within tiers of Carousel Stand for the Benchtop 138 is complementary in design to accommodate the planned one-fourth, one-third, one-half, and full height of individual containers and jars. However, spindle pole heights are larger than jar heights to accommodate hand operation clearances.

Recall that the interlocked container assembly of four one-fourth height wide-mouth jars is equivalent in height to a full height jar. The combined height of three one-third height wide-mouth jars is equivalent in height to a full height jar. Finally, the combined height of two one-half height wide-mouth jars is equivalent in height to a full height jar. The longer length of Full Height Spindle Pole 152 will accommodate the storage and access to a shorter full height container In FIG. 20, for added structural strength, the plurality of Full Height Spindle Pole 152 may be added in the additional support threaded holes of Tote Base 116 and Brace Bar Single Plate 164 by means of a plurality of "U" Shaped Brace Plate 166. This completes the assembly of First Tier 168 to Carousel Stand for the Benchtop 138. Additional, tiers maybe added vertically in like manner, while additional horizontal modular growth is also possible.

FIG. 21 is a top view of Carousel Stand for the Benchtop 138 with Modular Tote Base 142 and Modular Brace Bar 156 sections but without carousel jar holding disks. The threaded centered holes of Tote Stand Pole 126 are shown which hold carousel disks bearing on the hubs of spindle poles. A plurality of Spindle Support Pole 170 holes are shown which are threaded with poles and connect to "U" Shaped Brace Plate 166 end holes for structural strength. The center hole of "U" Shaped Brace Plate 166 are secured and rest on Tote Stand Pole 126.

FIG. 22 is a top view of the plurality of Carousel Disk Container Holder 154. By design each Carousel Disk Container Holder 154 may be of the same disk diameter to accommodate the planned compatible widths of modular bases and support plates. From left to right are Large Jar Size Carousel Disk 128, Medium Jar Size Carousel Disk 120, Small Jar Size Carousel Disk 122, and a Flare Layout small Jar Size Carousel Disk 172.

FIG. 23 is a top composite view of FIGS. 21 and 22. In FIG. 23, the planned spacing and integrated design of Carousel Stand for the Benchtop 138 is shown. The plurality of Carousel Disk Container Holder 154 rotates freely and provides high visibility and access to container contents. The plurality of Modular Tote Base 142 connect to the plurality of Tote Stand Pole 126 which provides bearing hubs for rest and rotation of the plurality of Carousel Disk Container Holder 154. Finally, the plurality of Spindle Support Pole 170 connects to both the plurality of Modular Brace Bar 156 and the plurality of "U" Shaped Brace Plate 166, to provide structural rigidity and strength.

Material selection for apparatus parts may include plastics, rubber, metal, ceramics, and combinations. The preferred embodiment includes Carousel Disk Container Holder 154 made of clear polycarbonate or other suitable strong material, poles or spindles made of polyvinyl chloride (PVC), Modular Tote Base 142 and Modular Brace Bar 156 made from molded plastics, Threaded Cap 158 made from molded plastic or metal, and Spacer or Handle Bar 162 made from molded plastic. Plastic fabrication may include Injection Molding, Blow Molding, Extrusions, and welded bodies when necessary.

Machinery that is capable of making these parts includes Cincinnati Milacron Machine Tools. The Cincinnati Milacron Plastics division has a wide range of equipment and molding technologies. A good mold maker or mold designer skilled in the art can design and produce these parts.

Advantages:

My storage system solution is a comprehensive interaction of containers, closures, holding apparatus and methodology that perform within an integrated system design. The implementation of interlocking connection hubs as integral and low profile connectors provide a link for storing, organizing, transporting, and presenting diverse container content collections. Holding apparatus with interlocking connection hubs provide the past missing link to integrate flexible, portable, fixturing and container contents. And this is accomplished in the workshop or at the remote worksite.

My Storage System Solution:

Tradesmen and home workshop hobbyists have historically stored their vast collections of bolts, nuts, and other fasteners in glass baby food jars and clear plastic food jars, with screw lid tops (e.g. 1½ quart peanut butter clear plastic jars). This storage system solution's preferred embodiment builds on this practice with a thoroughly well-thought-out mobile system to maximize the utilitarian effectiveness of easily picking up individual storage clear containers and quickly identifying highly visible contents. Through manipulations of tumbling and shaking the container's contents, the user is able to expose and reach a hand inside to grab, the once hard to find and reach desired fastener.

The see-thru plastic container jars are durable and lightweight. Each container has a wide-mouth opening, allowing an adult-sized hand to reach inside both medium and larger sized openings. Lids securely screw on, enabling containers to be shaken or dropped, without breaking and without the top coming off (scattering the contents everywhere). If the user prefers, optional container lids can be snap-on lid tops. The screw top and snap-on lid tops will securely fit on the same container jar's wide-mouth.

Container lid tops have clear solid plastic centers with color coded perimeter rim walls. Color rims help to organize and distinguish parts collections (e.g. green—electrical, blue—plumbing, red—nuts, yellow—washers, black—bolts, etc.). Screw lid tops are threading container closures. However, lids also have a Child-Resistant-Closure (CRC) combination, enabling containers to securely stack as interlocking container assemblies for convenient mobility, while maintaining clear viewing and quick access. The exterior bottoms of individual container jars have Child-Resistant-Closure tabs or hooks to facilitate secure interlocking to other containers with mating compatible CRC enabled closures.

This storage system solution organizes and stores fasteners, tooling, and collectables, in visually clear and durable plastic jars, pie-shaped containers, and revolving trays. This clear container design concept is used throughout the product line. A collection or assembly of varied sized container jars, lids, trays, pie-shaped containers, and organizational accessories are held by tote trays and expandable and reconfigurable revolving carousel tree stands.

The carousel tree stand is reconfigurable and expands in a vertical direction, using a common component structural design. A starter mobile single tree stand, using the modular design, expands vertically by tiers and horizontally, into larger floor and workbench stands. This storage system solution's component collections are easily customized into an integrated and flexible storage system. Each system is quickly reconfigured by individual users (both amateur and professional) to adapt to their changing task needs and work preferences.

Interlocking container assemblies as a plurality of container jars forming a columnar or tube stack are transportable with an easily attached set of fabric loop strapping and collectively attached to a shoulder harness.

A few product design principles guide this storage system solution. Construction is durable plastic (e.g. polycarbonate, PVC, vinyl, PET or polymer) and lightweight. Plastic is visually clear to permit easy inspection of container contents. Plastic jars, lids, containers, trays, and accessories are durable, rust-resistant, and easy to clean with soap and water.

Container product is capable of secure and organized stacking. A block design theme with rounded edges is maintained system-wide, so protruding handles, wheels, latches, hinges, etc. are minimized. Working hardware is recessed within the product's housing walls. Mobility, flexible, and convenience of operation for a pleasant user's interactive experience is emphasized.

Product use, flexibility, and mobility are key design features. Product may be used in a stationary setting with a large benchtop stand configuration or transported in one of many mobile options. Mobile options include 1)singe Tote Tree Stand, 2)shoulder harness strap and tentacles strapped to jar assemblies, 3)Mobile Tree Stand with Two Wheel Floor Base space bar, 4)Base Spacer bars with Handles, 5)Tote Hanging Tray, and 6)Carousel Discs with finger holes. The user decides among these many options using his or her preferences.

The inherent flexibility of this storage system solution product design provides a wide application of product use for customized storage and organization. Collection sets can be preconfigured to target specific uses and markets such as fastener storage, electrical connectors, plumbing parts, scrapbooking, stamp collecting, coin collecting, card collecting, or general purpose. By design, the user preferentially configures their storage system solution in a manner best suited to their personal work tasks and habits.

My interlocking container assembly and storage system describes a system for the packaging, storage, and handling of containers. Container design, storage methodology and holding apparatus are presented for the secure, efficient, cost effective plurality assembly and transport of containers.

Additional Embodiments

Additional embodiments may include modifications to the specifics of Child Resistant Closure (CRC) hardware. The design of interlocking connection hubs should focus on quickly enabled and disabled secure connections. Interlocking connections should not duplicate the fastening motion of the container's closure. Further, adhere to the principle that intentional motion disengagement of an interlocking connection does not unintentionally disengage a closure fastening. Likewise, an intentional motion disengagement of a closure fastening does not unintentionally disengage an interlocking connection.

Applications may be more desirable where the interlocking container assembly connection is a threading closure and the container closure fastening is a CRC like mechanism.

While this storage system solution's preferred embodiment is clear plastic wide-mouth jars, the spirit of this invention is open to different container and closure configurations of color, body clarity, size, shape, material, accessory addition, and other alterations.

Further, as a raised jar collar neck is preferred for a more definitive grasping surface by disk slots or mechanical fingers, this is not a necessity.

The carousel stand's spindle and support poles lengths of one-fourth, one-third, one-half, and full height are to be sized to accommodate the interlocking container assembly heights of one-fourth, one-third, one-half, and full height. This stipulates that the stand's pole full height length is equivalent or larger to an interlocking container assembly of full height.

Spring CRC Insert 42 of FIG. 5 may be replaced with a convex shaped container bottom which would have sufficient flex for the desired spring load. Then, this spring force possibly could be a one part molded bottom to the container.

Further, in certain container and closure mated combinations it may be preferential to have Spring CRC Insert 42 load require a pulling motion rather than pushing. The CRC fastening design arrangement would be reconfigured to accommodate this change. The interlocking disengagement may change from a simultaneous push and twist; to a pull and twist.

Tote Trays and Carousel disk may take different physical shapes for specific storage applications. Trays and disks may be used as inserts within drawer and tray bottoms. Then, drawers with CRC stud bottoms could be assembled into tote cases and filing cabinets.

As one skilled in the art will appreciate, none of the prior art utilizes a plurality of containers, lids, and holding apparatus for an integrated storage system as my storage system solution.

An assortment of container holding apparatus is presented but utilizing the strategic locating of a male interlocking container assembly connector can provide means for the enhancement of positioning containers mating this male connector to its compatible Female interlocking container assembly connector. By no means are the possibilities limited to those apparatus presented. The spirit of my storage system solution presents the opportunity to design other container holding apparatus that is compatible with an interlocking connector hub or Raised Collar Neck 30 FIG. 1 functionality.

CONCLUSION, RAMIFICATIONS, AND SCOPE OF INVENTION

Prior art is limited in its scope of providing a container storage system with individual reclosable containers that quickly engage and disengage in secure interlocking fashion with container assemblies and holding apparatus.

My storage system solution provides this and more functionality:

1. Within assemblies individual containers retain their own closure.
2. Each closure performs the function of secure container closure and of an interlocking connection hub.
3. Interlocking container assembly motion is a unique interactive movement with the user, not to be confused with the container closure interaction.
4. Individual containers and container assemblies interlock with my storage system solutions' holding apparatus, as defined earlier, providing an opportunity to organize and present container content both in the workshop but also at the remote worksite.
5. Home grown practices of users storing their hardware parts in baby food jar and peanut butter jars is expanded into a more comprehensive and convenient storage and parts access solution.
6. The preferred embodiment of wide-mouth clear plastic container jars provides a means for producers and manufacturers to package their products in my storage system solution's container. Then, motivated consumers will collect and use these containers within my storage system solution. This is far more efficient than throwing the plastic away as nonbiodegradable waste into garbage dumps.
7. With the preferred embodiment, users readily see and identify what is stored in their containers through clear containers and lids.
8. The simple adaptation of color coded plastic rims to container jars will help parts sorting and quick identification.
9. This storage system solution applies not only to wide-mouth jars in columnar assemblies but also many-sided orthogonal containers within a three-dimensional interlocking connected matrix.

While my above description contains many specificities, these should not be construed as limitations on the scope of my storage system solution, but rather as an exemplification of one preferred embodiment thereof. Many other variations are possible.

For Example, the inclusion of interchangeable tray inserts for interlocking holding of containers within drawer bottoms is means for adaptation by my Provision Patent Application No. 60/687,553. Further, interchangeable Tote Case halves decouple and slide as drawers within a stackable filing cabinet. The Tote Case is assembled from two drawers that are either one-fourth, one-third, one-half, or full height tall. This tote case performs as a portable toolbox or storage case.

CRC interlocked container assembly fastening could be flip-flopped with fastening Closure. Other prior art types of fastening mechanisms can replace the CRC fastening mechanism. The key is to choose a prior art fastening mechanism that does not replicate the fastening motion of a threading closure. And a fastening mechanism that will not separate due to expected gravitation forces or loads. When you pick up a vertical interlocked container assembly or stack of jars by the uppermost container, you do want the interlocked assembly to fail due to the weight of the load below the uppermost container you grasp.

There is a plurality of opportunity for creative container, closure, and container carrying or apparatus holding devices that are interactively linked by interlocking connection hubs.

Accordingly, the scope of my storage system solution should be determined not by the embodiments illustrated, but by the appended claims and their legal equivalents.

What is claimed is:

1. An interlocking assembly of containers, closures and a holding apparatus, the assembly comprising:

a plurality of containers, each container including a container body having a first end formed to include an access opening, a second closed end, and a base located at the second end, the base including a walled first connection hub having a plurality of spaced apart first locking members formed thereon;

a plurality of closures configured to be repeatably removed from and securely fastened to the first ends of the containers to selectively open and close the access openings, each closure including a walled second connection hub having a plurality of spaced apart second locking members formed thereon, the second locking members of closures being configured to engage the first locking members of an adjacent container body upon insertion of the closure into the base of the adjacent container, mating of the first and second connection hubs, and upon rotation of the adjacent containers relative to each other to lock the adjacent containers together in a stacked orientation, the locked first and second locking members preventing unintentional rotation and disengagement of the closure relative to the adjacent container; and a holding apparatus including at least one third connection hub having a plurality of spaced apart locking members formed thereon, and wherein at least one of the first locking members on the first connection hub of the containers or at least one of the second locking members on the second connection hub of the closures cooperate with the locking members of at least one third connection hub to secure at least one of the containers and the closures to the holding apparatus, thereby securing at least one or a plurality of containers in the stacked orientation to the holding apparatus, the locked first and second locking members and locking members on the connection hub preventing unintentional rotation and disengagement of the closure or container relative to each other and relative to the adjacent holding apparatus while configured to be repeatably secured and removed, and wherein the closures are repeatably coupled to the containers, respectively, by child resistant closure fasteners, and wherein the first locking members include a threaded portion formed on the containers and the second locking members include a threaded portion formed on the closures.

2. The interlocking assembly of claim 1, wherein the bases of the containers include an outer rim which forms the walled first connection hub of the base, the first locking members being formed on an inner surface of the base outer rim, and wherein the second locking members are formed on an outer surface of the walled second connection hub of the closures.

3. The interlocking assembly of claim 2, wherein the first locking members formed on the inner surface of the base outer rim are male tabs and the second locking members formed on the outer surface of the closure are female hooks configured to repeatably engage the male tabs to lock the adjacent containers together in the stacked orientation.

4. The interlocking assembly of claim 2, wherein the first locking members formed on the inner surface of the base outer rim are female hooks and the second locking members formed on the outer surface of the closure are male tabs configured to repeatably engage the female hooks to lock the adjacent containers together in the stacked orientation.

5. The interlocking assembly of claim 1, wherein the bases of the containers each include an identically sized stud, each stud defining the walled first connection hub of the base having the plurality of spaced apart first locking members formed thereon, and wherein the second connection hub of the closures each include an identically sized receptor, each receptor having an inner wall with the second locking members formed thereon, each receptor being configured so that the first and second locking members repeatably engage each other upon insertion of the stud into the receptor and rotation of the adjacent containers relative to each other.

6. The interlocking container assembly of claim 5, wherein the identically sized studs are cylindrically shaped and include an outer wall having the plurality of spaced apart first locking members formed thereon, and wherein the receptors are also cylindrically shaped and have an inner wall defining a recess sized to repeatably receive the cylindrically shaped stud therein, the inner wall of the receptor being formed to include the plurality of second locking members thereon.

7. The interlocking assembly of claim 1, wherein the containers each include a threaded portion adjacent the access opening and the closures each include a threaded portion configured to repeatably engage the threaded portion of the containers, respectively, to secure the closures to the containers, and wherein the first and second locking members are child resistant fasteners.

8. The interlocking assembly of claim 1, wherein the closures are secured to the containers by relative rotation of the closures and the containers in a first direction, and wherein the second locking members of the closures are configured to repeatably engage the first locking members of the containers upon rotation of the adjacent containers and upon relative movement of the adjacent containers along a longitudinal axis of the adjacent containers in a second direction transverse to the first direction to lock the adjacent containers together in the stacked orientation.

9. The interlocking assembly of claim 1, wherein the containers each further comprise a spring member located adjacent the second end, the spring member being configured to provide a spring force against a closure coupled to the base to provide a child resistant closure in combination with the first and second locking members.

10. The interlocking assembly of claim 9, wherein the closures each further comprise a locking tab formed on the closure wall, the locking tab being movable simultaneously with the spring member being compressed to permit relative rotation of the adjacent stacked containers to unlock the adjacent containers.

11. The interlocking assembly of claim 1, wherein the holding apparatus is one of a tray, a tote hanging tray, a carousel disk, and a one or more surface plane object.

12. An interlocking container assembly comprising:

at least first and second containers, each container including a container body having a first end formed to include an access opening, a second closed end, and a base located at the second end;

at least first and second closures configured to be repeatably removed from and securely fastened to the first ends of the first and second containers, respectively, to selectively open and close the access openings;

locking means formed on at least the base of the second container and the first closure for selectively locking the first and second containers together in a stacked orientation upon insertion of the first closure into the base of the second container and upon rotation of the first and second containers relative to each other, the locking means preventing unintentional rotation and disengagement of the first closure relative to the second container while permitting repeatable locking and unlocking of at least the first closure to the second container; and a holding apparatus including at least one connection hub, and wherein the locking means of at least one of the containers and the closures are configured to cooperate with the at least one connection hub to selectively secure at least one of the first and second containers and the first and second closures to the holding apparatus, thereby securing at least one or a plurality of the first and second containers in the stacked orientation to the holding apparatus, the locking means and the connection hub preventing unintentional rotation and disengagement of the closures and containers relative to each other and relative to the adjacent holding apparatus while configured to be repeatably secured and removed, wherein the first and second containers each include a longitudinal axis extending from the first open end to the second closed end, and further comprising means for biasing the first and second containers in a direction parallel to the longitudinal axis to hold the locking means in engagement with the connection hub, the first and second containers being movable along the longitudinal axis against the force of the biasing means to disengage of the locking means on the containers or closures from the connection hub, thereby permitting rotation of the first and second stacked containers relative to the connection hub to disengage the first and second containers from the connection hub.

13. An interlocking assembly of containers, closures and a holding apparatus, the assembly comprising:

a plurality of containers, each container including a container body having a first end formed to include an access opening, a second closed end, and a base located at the second end, the base including a walled first connection hub having a plurality of spaced apart first locking members formed thereon;

a plurality of closures configured to be repeatably removed from and securely fastened to the first ends of the containers to selectively open and close the access openings, each closure including a walled second connection hub having a plurality of spaced apart second locking members formed thereon, the second locking members of closures being configured to engage the first locking members of an adjacent container body upon insertion of the closure into the base of the adjacent container, mating of the first and second connection hubs, and upon rotation of the adjacent containers relative to each other to lock the adjacent containers together in a stacked orientation, the locked first and second locking members preventing unintentional rotation and disengagement of the closure relative to the adjacent container; and a holding apparatus including at least one third connection hub having a plurality of spaced apart locking members formed thereon, and wherein at least one of the first locking members on the first connection hub of the containers or at least one of the second locking members on the second connection hub of the closures cooperate with the locking members of at least one third connection hub to secure at least one of the containers and the closures to the holding apparatus, thereby securing at least one or a plurality of containers in the stacked orientation to the holding apparatus, the locked first and second locking members and locking members on the connection hub preventing unintentional rotation and disengagement of the closure or container relative to each other and relative to the adjacent holding apparatus while configured to be repeatably secured and removed, wherein the first connection hubs of the containers each include an identically sized first connector, each first connector defining the wall of the base having the plurality of spaced apart first locking members formed thereon, and wherein the second connection hub of the closures each include an identically sized second connector, each second connector having a wall with the second locking members formed thereon, the first and second connectors being configured to mate so that the first and second locking members repeatably engage each other upon insertion of one of the closures into the base of the adjacent container and upon rotation of the adjacent containers relative to each other to lock the adjacent second containers together in the stacked orientation, and wherein the containers have different sizes, the identically sized first connectors and identically sized second connectors permitting the different sized containers to be repeatably locked together in the stacked orientation.

14. The interlocking assembly of claim 13, wherein the closures are repeatably coupled to the containers, respectively, by child resistant closure fasteners, and wherein the first locking members include a threaded portion formed on the containers and the second locking members include a threaded portion formed on the closures.

15. The interlocking assembly of claim 13, wherein the closures have different sizes to repeatably mate with the different sized containers each of the closures including the identically sized second connectors to repeatably mate with the identically sized first connectors to permit the different sized containers having different sized closures to be selectively locked together in the stacked orientation.

16. An interlocking assembly of containers, closures and a holding apparatus, the assembly comprising:

a plurality of containers, each container including a container body having a first end formed to include an access opening, a second closed end, and a base located at the second end, the base including a walled first connection hub having a plurality of spaced apart first locking members formed thereon;

a plurality of closures configured to be repeatably removed from and securely fastened to the first ends of the containers to selectively open and close the access openings, each closure including a walled second connection hub having a plurality of spaced apart second locking members formed thereon, the second locking members of closures being configured to engage the first locking members of an adjacent container body upon insertion of the closure into the base of the adjacent container, mating of the first and second connection hubs, and upon rotation of the adjacent containers relative to each other to lock the adjacent containers together in a stacked orientation, the locked first and second locking members preventing unintentional rotation and disengagement of the closure relative to the adjacent container; and a holding apparatus including at least one third connection hub having a plurality of spaced apart locking members formed thereon, and wherein at least one of the first locking members on the first connection hub of the containers or at least one of the second locking members on the second connection hub of the closures cooperate with the locking members of at least one third connection hub to secure at least one of the containers and the closures to the holding apparatus, thereby securing at least one or a plurality of containers in the stacked orientation to the holding apparatus, the locked first and second locking members and locking members on the connection hub preventing unintentional rotation and disengagement of the closure or container relative to each other and relative to the adjacent holding apparatus while configured to be repeatably secured and removed, wherein the first connection hubs of the containers each include an identically sized first connector, each first connector defining the wall of the base having the plurality of spaced apart first locking members formed thereon, and wherein the second connection hub of the closures each include an identically sized second connector, each second connector having a wall with the second locking members formed thereon, the first and second connectors being configured to mate so that the first and second locking members repeatably engage each other upon insertion of one of the closures into the base of the adjacent container and upon rotation of the adjacent containers relative to each other to lock the adjacent second containers together in the stacked orientation, and wherein the identically sized first connectors are cylindrically shaped studs including an outer wall having the plurality of spaced apart first locking members formed thereon, and wherein the identically sized second connectors are cylindrically shaped receptors having an inner wall defining a recess sized to repeatably receive the cylindrically shaped stud therein, the inner wall of each receptor being formed to include the plurality of second locking members thereon.

17. An interlocking assembly of containers, closures and a holding apparatus, the assembly comprising:

a plurality of containers, each container including a container body having a first end formed to include an access opening, a second closed end, and a base located at the second end, the base including a walled first connection hub having a plurality of spaced apart first locking members formed thereon;

a plurality of closures configured to be repeatably removed from and securely fastened to the first ends of the containers to selectively open and close the access openings, each closure including a walled second connection hub having a plurality of spaced apart second locking members formed thereon, the second locking members of closures being configured to engage the first locking members of an adjacent container body upon insertion of the closure into the base of the adjacent container, mating of the first and second connection hubs, and upon rotation of the adjacent containers relative to each other to lock the adjacent containers together in a stacked orientation, the locked first and second locking members preventing unintentional rotation and disengagement of the closure relative to the adjacent container; and a holding apparatus including at least one third connection hub having a plurality of spaced apart locking members formed thereon, and wherein at least one of the first locking members on the first connection hub of the containers or at least one of the second locking members on the second connection hub of the closures cooperate with the locking members of at least one third connection hub to secure at least one of the containers and the closures to the holding apparatus, thereby securing at least one or a plurality of containers in the stacked orientation to the holding apparatus, the locked first and second locking members and locking members on the connection hub preventing unintentional rotation and disengagement of the closure or container relative to each other and relative to the adjacent holding apparatus while configured to be repeatable secured and removed, wherein the bases of the containers include an outer rim which forms the walled first connection hub of the base, the first locking members being formed on an inner surface of the base outer rim, and wherein the second locking members are formed on an outer surface of the walled second connection hub of the closures, and wherein the containers each include a longitudinal axis extending from the first open end to the second closed end, and the first locking members formed on the inner surface of the base outer rim are male tabs and the second locking members formed on the outer surface of the second walled connection hub of the closure are female hooks defining a notched portion configured to engage the male tabs on three sides of the tab to repeatably lock and repeatably unlock the containers together in the stacked orientation.

18. The interlocking assembly of claim 17, further comprising a spring configured to bias the closure relative to the container to hold the male tabs in the notched portions of the female hooks, the adjacent stacked containers being movable relative to each other along the longitudinal axis to disengage of the male tabs from the notched portions of the female hooks, thereby permitting rotation of the adjacent stacked containers relative to each other to repeatably disengage the containers from the stacked orientation.

* * * * *